US012258115B2

(12) United States Patent
Derginer et al.

(10) Patent No.: US 12,258,115 B2
(45) Date of Patent: Mar. 25, 2025

(54) MARINE PROPULSION SYSTEM AND JOYSTICK CONTROL METHOD

(71) Applicant: Brunswick Corporation, Mettawa, IL (US)

(72) Inventors: Matthew E. Derginer, Butte des Mort, WI (US); Troy R. Brockdorf, Omro, WI (US); Travis C. Malouf, Germantown, WI (US)

(73) Assignee: Brunswick Corporation, Mettawa, IL (US)

( * ) Notice: Subject to any disclaimer, the term of this patent is extended or adjusted under 35 U.S.C. 154(b) by 199 days.

(21) Appl. No.: 17/869,533

(22) Filed: Jul. 20, 2022

(65) Prior Publication Data

US 2024/0025528 A1 Jan. 25, 2024

(51) Int. Cl.

| | |
|---|---|
| ***B63H 25/02*** | (2006.01) |
| ***B63B 39/06*** | (2006.01) |
| ***B63H 21/21*** | (2006.01) |
| ***B63H 25/42*** | (2006.01) |

(52) U.S. Cl.

CPC ..... *B63H 25/02* (2013.01); *B63H 21/213* (2013.01); *B63H 25/42* (2013.01); *B63B 39/061* (2013.01); *B63H 2025/026* (2013.01)

(58) Field of Classification Search

None

See application file for complete search history.

(56) References Cited

U.S. PATENT DOCUMENTS

| | | | |
|---|---|---|---|
| 3,688,252 | A | 8/1972 | Thompson |
| 3,715,571 | A | 2/1973 | Braddon |
| 3,754,399 | A | 8/1973 | Ono et al. |
| 3,771,483 | A | 11/1973 | Spencer |
| 3,842,789 | A | 10/1974 | Bergstedt |
| 4,231,310 | A | 11/1980 | Muramatsu |
| 4,253,149 | A | 2/1981 | Cunningham et al. |
| 4,428,052 | A | 1/1984 | Robinson et al. |
| 4,501,560 | A | 2/1985 | Brandt et al. |

(Continued)

FOREIGN PATENT DOCUMENTS

| | | |
|---|---|---|
| CA | 2279165 | 1/2001 |
| CA | 2282064 | 1/2001 |

(Continued)

OTHER PUBLICATIONS

Arbuckle et al., "System and Method for Controlling a Position of a Marine Vessel Near an Object," Unpublished U.S. Appl. No. 15/818,226, filed Nov. 20, 2017.

(Continued)

*Primary Examiner* — Todd Melton

(74) *Attorney, Agent, or Firm* — Andrus Intellectual Property Law, LLP

(57) ABSTRACT

A marine propulsion system for a marine vessel including a joystick, at least one steerable and trimmable marine drive, and a control system configured to receive a user input to engage full vessel control mode, receive a vessel speed parameter, and receive a joystick position from the joystick. The control system determines a thrust command, a steering command, and a trim command for the at least one marine drive based on the joystick position and the vessel speed parameter and to control the at least one marine drive accordingly.

33 Claims, 8 Drawing Sheets

(56) References Cited

U.S. PATENT DOCUMENTS 4,513,378 A 4/1985 Antkowiak
4,589,850 A 5/1986 Soderbaum
4,625,583 A 12/1986 Kronogard
4,643,687 A 2/1987 Yano et al.
4,652,878 A 3/1987 Borgersen
4,741,713 A 5/1988 Ohlsson et al.
4,781,631 A 11/1988 Uchida et al.
4,813,895 A 3/1989 Takahashi
4,892,494 A 1/1990 Ferguson
4,939,661 A 7/1990 Barker et al.
4,975,709 A 12/1990 Koike
5,067,918 A 11/1991 Kobayashi
5,172,324 A 12/1992 Knight
5,202,835 A 4/1993 Knight
5,331,558 A 7/1994 Hossfield et al.
5,362,263 A 11/1994 Petty
5,386,368 A 1/1995 Knight
5,390,125 A 2/1995 Sennott et al.
5,491,636 A 2/1996 Robertson et al.
5,736,962 A 4/1998 Tendler
5,884,213 A 3/1999 Carlson
6,059,226 A 5/2000 Cotton et al.
6,092,007 A 7/2000 Cotton et al.
6,113,443 A 9/2000 Eichinger
6,142,841 A 11/2000 Alexander, Jr. et al.
6,146,219 A 11/2000 Blanchard
6,230,642 B1 5/2001 Mckenney et al.
6,234,100 B1 5/2001 Fadeley et al.
6,234,853 B1 5/2001 Lanyi et al.
6,279,499 B1 8/2001 Griffith, Sr. et al.
6,308,651 B2 10/2001 Mckenney et al.
6,336,833 B1 1/2002 Rheault et al.
6,340,290 B1 1/2002 Schott et al.
6,342,775 B1 1/2002 Sleder, Sr.
6,350,164 B1 2/2002 Griffith, Sr. et al.
6,354,237 B1 3/2002 Gaynor et al.
6,354,892 B1 3/2002 Staerzl
6,361,387 B1 3/2002 Clarkson
6,363,874 B1 4/2002 Griffith, Sr.
6,377,889 B1 4/2002 Soest
6,402,577 B1 6/2002 Treinen et al.
6,416,368 B1 7/2002 Griffith, Sr. et al.
6,428,371 B1 8/2002 Michel et al.
6,446,003 B1 9/2002 Green et al.
6,485,341 B1 11/2002 Layni et al.
6,488,552 B2 12/2002 Kitsu et al.
6,511,354 B1 1/2003 Gonring et al.
6,582,260 B2 6/2003 Nemoto et al.
6,583,728 B1 6/2003 Staerzl
6,604,479 B2 8/2003 Mckenney et al.
6,678,589 B2 1/2004 Robertson et al.
6,705,907 B1 3/2004 Hedlund
6,743,062 B1 6/2004 Jones
6,773,316 B1 8/2004 Keehn, Jr.
6,848,382 B1 2/2005 Bekker
6,875,065 B2 4/2005 Tsuchiya et al.
6,884,130 B2 4/2005 Okabe
6,885,919 B1 4/2005 Wyant et al.
6,910,927 B2 6/2005 Kanno
6,923,136 B1 8/2005 D'Alessandro
6,994,046 B2 2/2006 Kaji et al.
6,995,527 B2 2/2006 Depasqua
7,001,230 B2 2/2006 Saito
RE39,032 E 3/2006 Gonring et al.
7,018,252 B2 3/2006 Simard et al.
7,036,445 B2 5/2006 Kaufmann et al.
7,059,922 B2 6/2006 Kawanishi
7,118,434 B2 10/2006 Arvidsson et al.
7,127,333 B2 10/2006 Arvidsson
7,128,625 B2 10/2006 Saito
7,131,386 B1 11/2006 Caldwell
7,188,581 B1 3/2007 Davis et al.
7,243,009 B2 7/2007 Kaji
7,267,068 B2 9/2007 Bradley et al.
7,268,703 B1 9/2007 Kabel et al.
7,305,928 B2 12/2007 Bradley et al.
7,366,593 B2 4/2008 Fujimoto et al.
7,389,165 B2 6/2008 Kaji
7,389,735 B2 6/2008 Kaji et al.
7,398,742 B1 7/2008 Gonring
7,416,458 B2 8/2008 Suemori et al.
7,438,013 B2 10/2008 Mizutani
7,467,595 B1 12/2008 Lanyi et al.
7,476,134 B1 1/2009 Fell et al.
7,481,688 B2 1/2009 Kobayashi
7,506,599 B2 3/2009 Mizutani
7,527,537 B2 5/2009 Mizutani
7,533,624 B2 5/2009 Mizutani
7,538,511 B2 5/2009 Samek
7,540,253 B2 6/2009 Mizutani
7,577,526 B2 8/2009 Kim et al.
7,674,145 B2 3/2010 Okuyama et al.
7,727,036 B1 6/2010 Poorman et al.
7,736,204 B2 6/2010 Kaji
7,753,745 B2 7/2010 Schey et al.
7,813,844 B2 10/2010 Gensler et al.
7,844,374 B2 11/2010 Mizutani
7,876,430 B2 1/2011 Montgomery
7,883,383 B2 2/2011 Larsson
7,930,986 B2 4/2011 Mizutani
7,959,479 B2 6/2011 Ryuman et al.
7,972,189 B2 7/2011 Urano
8,011,981 B2 9/2011 Mizutani
8,046,121 B2 10/2011 Mizutani
8,050,630 B1 11/2011 Arbuckle
8,051,792 B2 11/2011 Mochizuki
8,079,822 B2 12/2011 Kitsunai et al.
8,082,100 B2 12/2011 Grace et al.
8,105,046 B2 1/2012 Kitsunai et al.
8,113,892 B1 2/2012 Gable et al.
8,131,412 B2 3/2012 Larsson et al.
8,145,370 B2 3/2012 Borrett
8,145,371 B2 3/2012 Rae et al.
8,155,811 B2 4/2012 Noffsinger et al.
8,170,734 B2 5/2012 Kaji
8,170,735 B2 5/2012 Kaji
8,195,381 B2 6/2012 Arvidsson
8,265,812 B2 9/2012 Pease
8,271,155 B2 9/2012 Arvidsson
8,276,534 B2 10/2012 Mochizuki
8,277,270 B2 10/2012 Ryuman
8,376,793 B2 2/2013 Chiecchi
8,417,399 B2 4/2013 Arbuckle et al.
8,428,801 B1 4/2013 Nose et al.
8,478,464 B2 7/2013 Arbuckle et al.
8,480,445 B2 7/2013 Morvillo
8,510,028 B2 8/2013 Grace et al.
8,515,660 B2 8/2013 Grace et al.
8,515,661 B2 8/2013 Grace et al.
8,527,192 B2 9/2013 Grace et al.
8,543,324 B2 9/2013 Grace et al.
8,622,012 B2 1/2014 Olofsson
8,645,012 B2 2/2014 Salmon et al.
8,682,515 B2 3/2014 Ito
8,688,298 B2 4/2014 Mizutani et al.
8,694,248 B1 4/2014 Arbuckle et al.
8,761,976 B2 6/2014 Salmon et al.
8,797,141 B2 8/2014 Best et al.
8,831,802 B2 9/2014 Mizutani et al.
8,831,868 B2 9/2014 Grace et al.
8,838,305 B2 9/2014 Mizutani
8,944,865 B1 2/2015 Krabacher et al.
8,965,606 B2 2/2015 Mizutani
8,983,780 B2 3/2015 Kato et al.
9,032,891 B2 5/2015 Kinoshita et al.
9,032,898 B2 5/2015 Widmark
9,033,752 B2 5/2015 Takase
9,039,468 B1 5/2015 Arbuckle et al.
9,039,469 B1 5/2015 Calamia et al.
9,079,651 B2 7/2015 Nose et al.
9,108,710 B1 8/2015 McChesney et al.
9,126,667 B2 9/2015 Mizutani
9,132,900 B2 9/2015 Salmon et al.
9,150,294 B2 10/2015 Ito et al.

(56) References Cited

U.S. PATENT DOCUMENTS 9,150,298 B2 10/2015 Mizushima
9,162,743 B1 10/2015 Grace et al.
9,176,215 B2 11/2015 Nikitin et al.
9,183,711 B2 11/2015 Fiorini et al.
9,195,234 B2 11/2015 Stephens
9,248,898 B1 2/2016 Kirchhoff
9,261,048 B2 2/2016 Suzuki et al.
9,278,740 B1 3/2016 Andrasko et al.
9,296,456 B2 3/2016 Mochizuki et al.
9,355,463 B1 5/2016 Arambel et al.
9,359,057 B1 6/2016 Andrasko et al.
9,376,188 B2 6/2016 Okamoto
9,377,780 B1 6/2016 Arbuckle et al.
9,440,724 B2 9/2016 Suzuki et al.
9,545,988 B2 1/2017 Clark
9,594,374 B2 3/2017 Langford-Wood
9,594,375 B2 3/2017 Jopling
9,598,160 B2 3/2017 Andrasko et al.
9,615,006 B2 4/2017 Terre et al.
9,616,971 B2 4/2017 Gai
9,650,119 B2 5/2017 Morikami et al.
9,663,211 B2 5/2017 Suzuki et al.
9,694,885 B2 7/2017 Combee
9,718,530 B2 8/2017 Kabel et al.
9,727,202 B2 8/2017 Bamba
9,729,802 B2 8/2017 Frank et al.
9,733,645 B1 8/2017 Andrasko et al.
9,734,583 B2 8/2017 Walker et al.
9,764,807 B2 9/2017 Frisbie et al.
9,862,473 B2 1/2018 Rydberg et al.
9,878,769 B2 1/2018 Kinoshita et al.
9,996,083 B2 1/2018 Vojak
9,904,293 B1 2/2018 Heap et al.
9,908,605 B2 3/2018 Hayashi et al.
9,927,520 B1 3/2018 Ward et al.
9,937,984 B2 4/2018 Herrington et al.
9,950,778 B2 4/2018 Kabel et al.
9,963,214 B2 5/2018 Watanabe et al.
9,969,473 B2 5/2018 Okamoto
9,988,134 B1 6/2018 Gable et al.
10,011,342 B2 7/2018 Gai et al.
10,025,312 B2 7/2018 Langford-Wood
10,037,701 B2 7/2018 Harnett
10,048,690 B1 8/2018 Hilbert et al.
10,055,648 B1 8/2018 Grigsby et al.
10,071,793 B2 9/2018 Koyano et al.
10,078,332 B2 9/2018 Tamura et al.
10,094,309 B2 10/2018 Hagiwara et al.
10,095,232 B1 10/2018 Arbuckle et al.
10,106,238 B2 10/2018 Sidki et al.
10,124,870 B2 11/2018 Bergmann et al.
10,191,153 B2 1/2019 Gatland
10,191,490 B2 1/2019 Akuzawa et al.
10,431,099 B2 1/2019 Stewart et al.
10,198,005 B2 2/2019 Arbuckle et al.
10,259,555 B2 4/2019 Ward et al.
10,281,917 B2 5/2019 Tyers
10,322,778 B2 6/2019 Widmark et al.
10,330,031 B2 6/2019 Ohsara et al.
10,336,426 B2 7/2019 Naito et al.
10,338,800 B2 7/2019 Rivers et al.
10,372,976 B2 8/2019 Kollmann et al.
10,377,458 B1 8/2019 McGinley
10,437,248 B1 10/2019 Ross et al.
10,444,349 B2 10/2019 Gatland
10,457,371 B2 10/2019 Hara et al.
10,464,647 B2 11/2019 Tokuda
10,472,036 B2 11/2019 Spengler et al.
10,501,161 B2 12/2019 Tamura et al.
10,507,899 B2 12/2019 Imamura et al.
10,562,602 B1 2/2020 Gable et al.
10,618,617 B2 4/2020 Suzuki et al.
10,625,837 B2 4/2020 Ichikawa et al.
10,633,072 B1 4/2020 Arbuckle et al.
10,640,190 B1 5/2020 Gonring
10,671,073 B2 6/2020 Arbuckle et al.
10,739,771 B2 8/2020 Miller et al.
10,760,470 B2 9/2020 Li et al.
10,782,692 B2 9/2020 Tamura et al.
10,787,238 B2 9/2020 Watanabe et al.
10,795,366 B1 10/2020 Arbuckle et al.
10,845,811 B1 11/2020 Arbuckle et al.
10,871,775 B2 12/2020 Hashizume et al.
10,884,416 B2 1/2021 Whiteside et al.
10,913,524 B1 2/2021 Wald et al.
10,921,802 B2 2/2021 Bertrand et al.
10,926,855 B2 2/2021 Derginer et al.
10,953,973 B2 3/2021 Hayashi et al.
11,008,926 B1 5/2021 Osthelder et al.
11,009,880 B2 5/2021 Miller et al.
11,021,220 B2 6/2021 Yamamoto et al.
11,072,399 B2 7/2021 Terada
11,091,243 B1 8/2021 Gable et al.
11,117,643 B2 9/2021 Sakashita et al.
11,161,575 B2 11/2021 Koyano et al.
11,247,753 B2 2/2022 Arbuckle et al.
11,679,853 B2 * 6/2023 Wong ..... B63H 21/213 701/21
11,753,132 B1 * 9/2023 Nakayasu ..... B63H 20/12 701/21
2002/0127926 A1 9/2002 Michel et al.
2003/0137445 A1 7/2003 Rees et al.
2004/0221787 A1 11/2004 Mckenney et al.
2005/0075016 A1 4/2005 Bertetti et al.
2005/0170713 A1 8/2005 Okuyama
2006/0012248 A1 1/2006 Matsushita et al.
2006/0058929 A1 3/2006 Fossen et al.
2006/0089794 A1 4/2006 Despasqua
2006/0180070 A1 8/2006 Mizutani
2006/0217011 A1 9/2006 Morvillo
2007/0017426 A1 1/2007 Kaji et al.
2007/0032923 A1 2/2007 Mossman et al.
2007/0089660 A1 4/2007 Bradley
2007/0178779 A1 8/2007 Takada et al.
2007/0203623 A1 8/2007 Saunders et al.
2009/0037040 A1 2/2009 Salmon et al.
2009/0111339 A1 4/2009 Suzuki
2010/0076683 A1 3/2010 Chou
2010/0138083 A1 6/2010 Kaji
2011/0104965 A1 5/2011 Atsusawa
2011/0153125 A1 6/2011 Arbuckle et al.
2011/0172858 A1 7/2011 Gustin et al.
2012/0072059 A1 3/2012 Glaeser
2012/0248259 A1 10/2012 Page et al.
2013/0297104 A1 11/2013 Tyers et al.
2015/0032305 A1 1/2015 Lindeborg
2015/0089427 A1 3/2015 Akuzawa
2015/0246716 A1 9/2015 Skauen
2015/0276923 A1 10/2015 Song et al.
2015/0346722 A1 12/2015 Herz et al.
2015/0378361 A1 12/2015 Walker
2016/0214534 A1 7/2016 Richards et al.
2017/0176586 A1 6/2017 Johnson et al.
2017/0205829 A1 7/2017 Tyers
2017/0253314 A1 9/2017 Ward
2017/0255201 A1 9/2017 Arbuckle et al.
2017/0365175 A1 12/2017 Harnett
2018/0046190 A1 2/2018 Hitachi et al.
2018/0057132 A1 3/2018 Ward et al.
2018/0081054 A1 3/2018 Rudzinsky et al.
2018/0259338 A1 9/2018 Stokes et al.
2018/0259339 A1 9/2018 Johnson et al.
2019/0202541 A1 7/2019 Pettersson et al.
2019/0251356 A1 8/2019 Rivers
2019/0258258 A1 8/2019 Tyers
2019/0283855 A1 9/2019 Nilsson
2019/0382090 A1 12/2019 Suzuki et al.
2020/0108902 A1 4/2020 Wong et al.
2020/0130797 A1 4/2020 Mizutani
2020/0247518 A1 8/2020 Dannenberg
2020/0249678 A1 8/2020 Arbuckle et al.
2020/0269962 A1 8/2020 Gai et al.
2020/0298941 A1 9/2020 Terada et al.
2020/0298942 A1 9/2020 Terada et al.

(56) References Cited

U.S. PATENT DOCUMENTS

| | | | |
|---|---|---|---|
| 2020/0324864 | A1 | 10/2020 | Inoue |
| 2020/0331572 | A1 | 10/2020 | Inoue |
| 2020/0361587 | A1 | 11/2020 | Husberg |
| 2020/0369351 | A1 | 11/2020 | Behrendt et al. |
| 2020/0391838 | A1 | 12/2020 | Inoue et al. |
| 2020/0391840 | A1 | 12/2020 | Inoue et al. |
| 2020/0398964 | A1 | 12/2020 | Fujima et al. |
| 2021/0061426 | A1 | 3/2021 | Gai et al. |
| 2021/0070407 | A1 | 3/2021 | Ishii et al. |
| 2021/0070414 | A1 | 3/2021 | Bondesson et al. |
| 2021/0086876 | A1 | 3/2021 | Inoue et al. |
| 2021/0088667 | A1 | 3/2021 | Heling et al. |
| 2021/0107617 | A1 | 4/2021 | Nakatani |
| 2021/0141396 | A1 | 5/2021 | Kinoshita |
| 2021/0147053 | A1 | 5/2021 | Motose et al. |
| 2021/0155333 | A1 | 5/2021 | Mizutani |
| 2021/0163114 | A1 | 6/2021 | Bondesson et al. |
| 2021/0179244 | A1 | 6/2021 | Mizutani |
| 2021/0197940 | A1 | 7/2021 | Takase |
| 2021/0197944 | A1 | 7/2021 | Takase |
| 2021/0255627 | A1 | 8/2021 | Shih et al. |
| 2021/0261229 | A1 | 8/2021 | Terada |
| 2021/0263516 | A1 | 8/2021 | Miller et al. |
| 2021/0286362 | A1 | 9/2021 | Malouf et al. |
| 2021/0291943 | A1 | 9/2021 | Inoue et al. |
| 2021/0347449 | A1 | 11/2021 | Dake et al. |
| 2022/0126971 | A1 | 4/2022 | Matilainen et al. |

FOREIGN PATENT DOCUMENTS

| | | | |
|---|---|---|---|
| CN | 102015437 | | 10/2013 |
| CN | 106864696 | B | 1/2019 |
| CN | 109639314 | A | 4/2019 |
| CN | 209008841 | U | 6/2019 |
| CN | 107810139 | | 8/2019 |
| CN | 209192180 | U | 8/2019 |
| CN | 209321220 | U | 8/2019 |
| CN | 209410313 | U | 9/2019 |
| CN | 209410315 | U | 9/2019 |
| CN | 210101960 | U | 2/2020 |
| CN | 210101961 | U | 2/2020 |
| CN | 210191790 | U | 3/2020 |
| CN | 109625191 | B | 4/2020 |
| CN | 109693776 | B | 4/2020 |
| CN | 109591992 | B | 3/2021 |
| CN | 112968511 | A | 6/2021 |
| DE | 906907 | | 3/1954 |
| DE | 11 2013 004908 | | 6/2015 |
| EP | 423901 | | 4/1991 |
| EP | 816962 | | 1/1998 |
| EP | 1 775 212 | | 4/2007 |
| EP | 1477402 | | 1/2008 |
| EP | 1873052 | | 1/2008 |
| EP | 1535833 | | 12/2009 |
| EP | 2536622 | | 12/2012 |
| EP | 1923307 | | 2/2013 |
| EP | 1923309 | | 5/2013 |
| EP | 1923308 | | 6/2013 |
| EP | 2813423 | | 8/2016 |
| EP | 3 182 155 | | 6/2017 |
| EP | 2250077 | | 2/2018 |
| EP | 2703279 | | 6/2018 |
| EP | 3298302 | | 10/2019 |
| EP | 3643597 | | 4/2020 |
| EP | 3354557 | B1 | 5/2020 |
| EP | 3498589 | | 7/2020 |
| EP | 3805088 | | 4/2021 |
| EP | 3808646 | | 4/2021 |
| EP | 1770007 | | 5/2021 |
| EP | 3692604 | A1 | 6/2021 |
| EP | 3842332 | | 6/2021 |
| EP | 3842333 | | 6/2021 |
| EP | 3889030 | A1 | 10/2021 |
| EP | 3889031 | A1 | 10/2021 |
| GB | 1173442 | | 12/1969 |
| GB | 2180374 | | 3/1987 |
| JP | 50090088 | A | 7/1975 |
| JP | S58061097 | | 4/1983 |
| JP | 59110298 | U | 7/1984 |
| JP | 01178099 | A | 7/1989 |
| JP | 01284906 | A | 11/1989 |
| JP | 01285486 | A | 11/1989 |
| JP | 04019296 | A | 1/1992 |
| JP | H04101206 | | 2/1992 |
| JP | 04310496 | A | 11/1992 |
| JP | H07223591 | | 8/1995 |
| JP | 08056458 | A | 3/1996 |
| JP | 08056512 | A | 3/1996 |
| JP | 08056513 | A | 3/1996 |
| JP | 08058681 | A | 3/1996 |
| JP | 08127388 | A | 5/1996 |
| JP | 08187038 | A | 7/1996 |
| JP | 08266130 | A | 10/1996 |
| JP | 08266176 | A | 10/1996 |
| JP | 08276892 | A | 10/1996 |
| JP | 08276893 | A | 10/1996 |
| JP | 09048392 | A | 2/1997 |
| JP | 09048395 | A | 2/1997 |
| JP | 09048396 | A | 2/1997 |
| JP | 09052597 | A | 2/1997 |
| JP | 09109988 | A | 4/1997 |
| JP | 09142375 | A | 6/1997 |
| JP | 2926533 | | 7/1997 |
| JP | 09188293 | A | 7/1997 |
| JP | 09298929 | A | 11/1997 |
| JP | 09308352 | A | 12/1997 |
| JP | 10007090 | A | 1/1998 |
| JP | 10109689 | A | 4/1998 |
| JP | 11020780 | A | 1/1999 |
| JP | 7-246998 | | 10/1999 |
| JP | 2001146766 | A | 5/2001 |
| JP | 001206283 | A | 7/2001 |
| JP | 2002000038 | A | 1/2002 |
| JP | 3299664 | B2 | 7/2002 |
| JP | 3326055 | B2 | 9/2002 |
| JP | 3352847 | B2 | 12/2002 |
| JP | 3387699 | B2 | 3/2003 |
| JP | 3469978 | B2 | 11/2003 |
| JP | 3609902 | B2 | 1/2005 |
| JP | 3621374 | B2 | 2/2005 |
| JP | 3634007 | B2 | 3/2005 |
| JP | 2006159027 | A | 6/2006 |
| JP | 2007248336 | | 9/2007 |
| JP | 2007307967 | A | 11/2007 |
| JP | 4105827 | B2 | 6/2008 |
| JP | 4105828 | B2 | 6/2008 |
| JP | 2008221933 | A | 9/2008 |
| JP | 2009227035 | | 10/2009 |
| JP | 4421316 | B2 | 2/2010 |
| JP | 2010158965 | A | 7/2010 |
| JP | 4809794 | B2 | 11/2011 |
| JP | 4925950 | B2 | 5/2012 |
| JP | 5042906 | | 7/2012 |
| JP | 5189454 | B2 | 4/2013 |
| JP | 5213562 | B2 | 6/2013 |
| JP | 5226355 | | 7/2013 |
| JP | 5449510 | B2 | 3/2014 |
| JP | 5535373 | B2 | 7/2014 |
| JP | 2015033857 | A | 2/2015 |
| JP | 2015033858 | A | 2/2015 |
| JP | 2015199372 | A | 11/2015 |
| JP | 2015199373 | A | 11/2015 |
| JP | 5885707 | B2 | 3/2016 |
| JP | 2016049903 | | 4/2016 |
| JP | 2016074250 | | 5/2016 |
| JP | 2016159805 | A | 9/2016 |
| JP | 2016216008 | A | 12/2016 |
| JP | 2017136932 | A | 8/2017 |
| JP | 2017178242 | | 10/2017 |
| JP | 2017185885 | A | 10/2017 |
| JP | 2020032871 | A | 3/2020 |
| JP | 6820274 | | 1/2021 |
| JP | 2021071800 | A | 5/2021 |
| JP | 2021084565 | A | 6/2021 |

(56) References Cited

FOREIGN PATENT DOCUMENTS

| | | | |
|---|---|---|---|
| JP | 2021160373 | A | 10/2021 |
| KR | 20140011245 | | 1/2014 |
| SE | 540567 | | 10/2018 |
| WO | WO 1992005505 | | 4/1992 |
| WO | WO 9305406 | | 3/1993 |
| WO | WO 2006040785 | | 4/2006 |
| WO | WO 2006 062416 | | 6/2006 |
| WO | WO 2006058400 | | 6/2006 |
| WO | WO 2008066422 | | 6/2008 |
| WO | WO 2008111249 | | 8/2008 |
| WO | WO 2009113923 | | 9/2009 |
| WO | WO 2011099931 | | 8/2011 |
| WO | WO 2012010818 | | 1/2012 |
| WO | WO 2016091191 | A1 | 6/2016 |
| WO | WO 2016188963 | | 12/2016 |
| WO | WO 2016209767 | | 12/2016 |
| WO | WO 2017 095235 | | 6/2017 |
| WO | WO 2017167905 | | 10/2017 |
| WO | WO 2017168234 | | 10/2017 |
| WO | WO 2017202468 | A1 | 11/2017 |
| WO | WO 2018162933 | | 9/2018 |
| WO | WO 2018179447 | A1 | 10/2018 |
| WO | WO 2018183777 | | 10/2018 |
| WO | WO 2018201097 | | 11/2018 |
| WO | WO 2018232376 | | 12/2018 |
| WO | WO 2018232377 | | 12/2018 |
| WO | WO 2019011451 | | 1/2019 |
| WO | WO 2019011451 | A1 | 1/2019 |
| WO | WO 2019081019 | A1 | 5/2019 |
| WO | WO 2019096401 | | 5/2019 |
| WO | WO 2019126755 | | 6/2019 |
| WO | WO 2019157400 | | 8/2019 |
| WO | WO 2019201945 | | 10/2019 |
| WO | WO 2020/069750 | | 4/2020 |
| WO | WO 2020069750 | A1 | 4/2020 |
| WO | WO 2020147967 | A1 | 7/2020 |
| WO | WO 2020238814 | A1 | 12/2020 |
| WO | WO 2020251552 | A1 | 12/2020 |
| WO | WO 2021058388 | A1 | 4/2021 |

OTHER PUBLICATIONS

Arbuckle et al., "System and Method for Controlling a Position of a Marine Vessel Near an Object," Unpublished U.S. Appl. No. 15/818,233, filed Nov. 20, 2017.

John Bayless, Adaptive Control of Joystick Steering in Recreational Boats, Marquette University, Aug. 2017, https://epublications.marquette.edu/cgi/viewcontent.cgi?article=1439&context=theses_open.

Mercury Marine, Axius Generation 2 Installation Manual, Jul. 2010, pp. 22-25.

Mercury Marine, Joystick Piloting for Outboards Operation Manual, 2013, pp. 24-26.

Mercury Marine, Zeus 3000 Series Pod Drive Models Operation Manual, 2013, pp. 49-52.

Poorman et al., "Multilayer Control System and Method for Controlling Movement of a Marine Vessel", Unpublished U.S. Appl. No. 11/965,583, filed Dec. 27, 2007.

Search Report dated Apr. 22, 2020 in counterpart European Patent Application 19205213.2.

Translation of rejection dated Mar. 3, 2020 in counterpart Japan Patent Application 2019-190603.

Unpublished U.S. Appl. No. 16/535,946.

Ward et al., "Methods for Controlling Movement of a Marine Vessel Near an Object," Unpublished U.S. Appl. No. 15/986,395, filed May 22, 2018.

"Joystick Driving: Experience A New and Intuitive Way of Boat Driving," Volvo Penta, Goteborg, Sweden, Mar. 2017, 2 pages.

Extended European Search Report, dated Dec. 12, 2023, in corresponding EP Application No. 23186660.9.

Kirchoff, Unpublished U.S. Appl. No. 17/131,115, filed Dec. 22, 2020.

Kraus, Unpublished U.S. Appl. No. 17/185,289, filed Feb. 25, 2021.

* cited by examiner

MARINE PROPULSION SYSTEM AND JOYSTICK CONTROL METHOD

FIELD

The present disclosure generally relates to methods and systems for providing and controlling marine propulsion, including systems and methods for controlling propulsion speed, yaw, roll, and pitch of a marine vessel using a joystick.

BACKGROUND

Each of the following patents is hereby incorporated herein by reference in its entirety.

U.S. Pat. No. 7,188,581 discloses a marine drive and a marine vessel and drive combination having a trim tab with a forward end pivotally mounted to a marine propulsion device.

U.S. Pat. No. 7,398,742 discloses a steering assist system providing differential thrusts by two or more marine drives in order to create a more effective turning moment on a marine vessel. The differential thrusts can be selected as a function of the magnitude of turn commanded by an operator of the marine vessel and, in addition, as a function of the speed of the marine vessel at the time when the turning command is received.

U.S. Pat. No. 9,039,468 discloses a system that controls speed of a marine vessel that includes first and second marine drives that produce first and second thrusts to propel the marine vessel. A control circuit controls orientation of the marine drives between an aligned position in which the thrusts are parallel and an unaligned position in which the thrusts are non-parallel. A first user input device is moveable between a neutral position and a non-neutral detent position. When the first user input device is in the detent position and the marine drives are in the aligned position, the thrusts propel the marine vessel in a desired direction at a first speed. When a second user input device is actuated while the first user input device is in the detent position, the marine drives move into the unaligned position and propel the marine vessel in the desired direction at a second, decreased speed without altering the thrusts.

U.S. Pat. No. 9,278,740 discloses a system for controlling an attitude of a marine vessel having first and second trim tabs that includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 9,598,160 discloses a system and method for controlling a trim device that positions a trimmable marine apparatus with respect to a marine vessel. The trim system is operated in an automatic mode, in which a controller sends signals to actuate the trim device automatically as a function of vessel or engine speed, or a manual mode, in which the controller sends signals to actuate the trim device in response to commands from an operator input device. An operating speed of the propulsion system is determined. When the operating speed has crossed a given operating speed threshold, the trim system is subsequently operated in the automatic or manual mode depending on whether the operating speed increased or decreased as it crossed the operating speed threshold and whether the trim system was operating in the automatic or manual mode as the operating speed crossed the operating speed threshold.

U.S. Pat. No. 9,733,645 discloses a system and method for controlling handling of a marine vessel having a steerable component that is steerable to a plurality of positions to vary a direction of movement of the vessel. A controller is communicatively connected to an actuator of the steerable component and a user input device provides to the controller an operator-initiated steering command to steer the steerable component to one of the plurality of positions. A sensor provides to the controller an indication of an undesired course change of the marine vessel. The controller has a vessel direction control section that outputs a command to the actuator to change a position of the steerable component from the one of the plurality of positions so as to automatically counteract the undesired course change. The vessel direction control section is active only when the operator-initiated steering command is less than or equal to a predetermined threshold.

U.S. Pat. No. 10,926,855 discloses a method for controlling low-speed propulsion of a marine vessel powered by a marine propulsion system having a plurality of propulsion devices that includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

U.S. Pat. No. 11,247,753 discloses a method for maintaining a marine vessel at a global position and/or heading that includes receiving measurements related to vessel attitude and estimating water roughness conditions based on the measurements. A difference between the vessel's actual global position and the target global position and/or a difference between the vessel's actual heading and the target heading are determined. The method includes calculating a desired linear velocity based on the position difference and: or a desired rotational velocity based on the heading difference. The vessel's actual linear velocity and/or actual rotational velocity are filtered based on the roughness conditions. The method includes determining a difference between the desired linear velocity and the filtered actual linear velocity and/or a difference between the desired rotational velocity and the filtered actual rotational velocity. The method also includes calculating vessel movements that will minimize the linear velocity difference and/or rotational velocity difference and carrying out the calculated movements.

U.S. Publication No. 2020/0247518 discloses a marine propulsion system that includes at least one propulsion device and a user input device configured to facilitate input for engaging automatic propulsion control functionality with respect to a docking surface, wherein the user input device includes a direction indicator display configured to visually indicate a direction with respect to the marine vessel. A controller is configured to identify a potential docking surface, determine a direction of the potential docking surface with respect to the marine vessel, and control the direction indicator display to indicate the direction of the potential docking surface with respect to the marine vessel. When a user selection is received via the user input device to select the potential docking surface as a selected clocking surface, and propulsion of the marine vessel is automatically controlled by controlling the at least one propulsion device to move the marine vessel with respect to the selected docking surface.

U.S. application Ser. No. 16/535,946 discloses a steering system on a marine vessel that includes at least one propulsion device, a steering actuator that rotates the propulsion device to effectuate steering, at least one trim device moveable to adjust a running angle of the vessel, and a trim actuator configured to move the trim device so as to adjust the running angle. The system further includes a control system configured to determine a desired roll angle and at least one of a desired turn rate and a desired turn angle for the marine vessel based on steering instructions. The control system then controls the steering actuator to the rotate the at least one propulsion device based on the desired turn rate and/or the desired turn angle, and to control the trim actuator to move the at least one trim device based on the desired roll angle so as to effectuate the steering instruction.

U.S. application Ser. No. 17/131,115 discloses a method of controlling an electric marine propulsion system configured to propel a marine vessel including measuring at least one parameter of an electric motor in the electric marine propulsion system and determining that the parameter measurement indicates an abnormality in the electric marine propulsion system. A reduced operation limit is then determined based on the at least one parameter measurement, wherein the reduced operation limit includes at least one of a torque limit, an RPM limit, a current limit, and a power limit. The electric motor is then controlled such that the reduced operation limit is not exceeded.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect, a marine propulsion system for a marine vessel includes a joystick, at least one steerable and trimmable marine drive, and a control system configured to receive a user input to engage full vessel control mode, receive a vessel speed parameter, and receive a joystick position from the joystick. The control system determines a thrust command, a steering command, and a trim command for the at least one marine drive based on the joystick position and the vessel speed parameter and to control the at least one marine drive accordingly.

In one embodiment, the control system is further configured to hold a current vessel velocity and a current vessel heading when the joystick position is a centered position.

In one embodiment, the vessel speed parameter is one of a current vessel speed, a current rotational speed of the at least one marine drive, or a current demand percent for the at least one marine drive.

In one embodiment, the system further comprising at least two marine drives, wherein the control system is further configured to, when the full vessel control mode is engaged, determine the same steering command for each of the at least two marine drives such that they are steered in parallel.

In one embodiment, the control system is configured to decrease a maximum trim position and a maximum steering angle and/or a maximum trim change rate and a maximum steering change rate for the at least one marine drive commandable by the joystick based on the vessel speed parameter value.

In one embodiment, the system is configured in the full vessel control mode such that a maximum vessel speed is commandable by the joystick up to a maximum output capability of the at least one marine drive.

In one embodiment, the control system is further configured to determine a commanded vessel acceleration and a commanded vessel turn rate based on the joystick position and the vessel speed parameter, and to determine the thrust command, the steering command, and/or the trim command based on the commanded vessel acceleration and the commanded vessel turn rate. Optionally, the control system is configured to determine the commanded acceleration based on a forward/backward aspect of the joystick position and to determine the commanded vessel turn rate based on a lateral aspect of the joystick position or a rotational aspect of the joystick position.

In one embodiment, the control system is further configured to progressively decrease the commanded vessel turn rate associated with the joystick position as the vessel speed parameter increases above a threshold speed. Optionally, the system further comprises a navigation sensor system configured to measure vessel turn and vessel velocity, wherein the control system is further configured to implement a closed-loop controller to determine the thrust command, the steering command, and/or the trim command for the at least one marine drive based on the measured vessel velocity and the measured vessel turn to effectuate the commanded vessel acceleration and the commanded vessel turn rate.

In one embodiment, the system includes a set of trim tabs, and the control system is further configured to determine a tab position for each of the set of trim tabs based on the joystick position and the vessel speed parameter and to control the set of trim tabs accordingly. Optionally, the control system is further configured to progressively decrease a maximum tab position for the set of trim tabs commandable by the joystick as the vessel speed parameter increases above a threshold speed.

In one embodiment, the control system is further configured to receive a user input to disengage the full vessel control mode, and then to control the at least one marine drive to decelerate the marine vessel at a predetermined deceleration rate until the vessel speed parameter reaches an idle speed.

In one aspect, a method of controlling propulsion of a marine vessel includes receiving a user input to engage full vessel control mode, receiving a vessel speed parameter, receiving a joystick position from a joystick, and determining a thrust command, a steering command, and a trim command based on the joystick position and the vessel speed parameter. An output of at least one marine drive is controlled based on the thrust command, a steering position of the at least one marine drive is controlled based on the steering command, and at least one trimmable device is controlled based on the trim command.

In one embodiment, the method includes controlling the at least one marine drive to maintain a current vessel velocity and a current vessel heading when the joystick position is a centered position until a joystick handle is moved away from the centered position or a user input is received to disengage the full vessel control mode.

In one embodiment, the method includes progressively decreasing a maximum trim position and a maximum steering angle and/or a maximum trim change rate and a maximum steering change rate of the at least one marine drive commandable by the joystick based on the vessel speed parameter value.

In one embodiment, the method includes a commanded vessel acceleration and a commanded vessel turn rate based on the joystick position and the vessel speed parameter, and determining the thrust command, the steering command, and/or the trim command based on the commanded vessel acceleration and the commanded vessel turn rate. Optionally, the method further includes determining the commanded acceleration based on a forward/backward aspect of the joystick position and determining the commanded vessel turn rate based on a lateral aspect of the joystick position or a rotational aspect of the joystick position.

In one embodiment, the method includes progressively decreasing a commanded vessel turn rate associated with the joystick position as the vessel speed parameter increases above a threshold speed.

In one embodiment, the method includes measuring vessel turn and vessel velocity, and implementing a closed-loop controller to determine the thrust command, the steering command, and/or the trim command for the at least one marine drive based on the measured vessel velocity and the measured vessel turn to effectuate the commanded vessel acceleration and the commanded vessel turn rate.

In one embodiment, the method includes comprising implementing the closed-loop controller to determine a tab position for each of a set of trim tabs to effectuate a desired vessel pitch angle and a desired vessel roll angle based on the commanded vessel acceleration and the commanded vessel turn rate.

In one embodiment, the method includes a tab position for each of a set of trim tabs based on the joystick position and the vessel speed parameter and controlling the set of trim tabs accordingly, and progressively decreasing a maximum tab position for the set of trim tabs commandable by the joystick as the vessel speed parameter increases above a threshold speed.

In one embodiment, the method includes a user input to disengage the full vessel control mode, and then automatically controlling the at least one marine drive to decelerate the marine vessel at a predetermined deceleration rate.

In one embodiment, the method includes, when the full vessel control mode is engaged, determining a commanded vessel acceleration and a commanded vessel turn rate based on the joystick position and the vessel speed parameter, and determining the thrust command, the steering command, and/or the trim command based on the commanded vessel acceleration and the commanded vessel turn rate; and when the full vessel control mode is disengaged, determining a commanded vessel velocity and a commanded vessel heading based on the joystick position, and determining a low-speed thrust command a low-speed steering command based on the commanded vessel velocity and the commanded vessel heading.

In one embodiment, the method includes, when the full vessel control mode is engaged, determining the commanded acceleration based on a forward/backward aspect of the joystick position and determining the commanded vessel turn rate based on a lateral aspect of the joystick position or a rotational aspect of the joystick position; and when the full vessel control mode is disengaged, determining a magnitude and direction of the commanded vessel velocity based on the forward/backward aspect and the lateral aspect of the joystick position, and determining the commanded vessel heading based on the rotational aspect of the joystick position.

In one embodiment, the method includes, when the full vessel control mode is disengaged, determining a magnitude of commanded velocity based on a deflection magnitude of the joystick from the centered position such that the magnitude of commanded velocity is equal for a given deflection magnitude in all linear directions.

In one aspect of the invention, a method of controlling propulsion of a marine vessel includes receiving a joystick position from a joystick, and determining a commanded velocity based on the joystick position, including a velocity magnitude and direction, such that the magnitude of commanded velocity is equal for a given joystick position magnitude in all linear directions for which the joystick can be deflected, and controlling a plurality of marine drives accordingly.

In one embodiment, a magnitude of commanded velocity is determined based on a deflection magnitude of the joystick position from the centered position.

In one embodiment, the direction of the velocity command is associated with a direction of the joystick position from the centered position.

In one embodiment, the method includes determining thrust commands and/or steering positions for each of a plurality of marine drives based on the velocity magnitude and direction. Optionally, the method includes implementing a closed-loop controller to determine the thrust command, the steering command, and/or the trim command for the at least one marine drive based on the measured vessel velocity.

In one embodiment, a thrust magnitude commanded based on a maximum forward joystick position is the same thrust magnitude commanded based on a maximum reverse joystick position and is the same thrust magnitude of a total thrust commanded based on a maximum lateral joystick position.

In one aspect of the invention, a method of controlling propulsion of a marine vessel includes receiving a joystick position from a joystick, and determining a thrust command for each of a plurality of marine drives based on the joystick position, wherein a magnitude of the thrust commanded based on a maximum forward joystick position is the same magnitude of the thrust commanded based on a maximum reverse joystick position, and is the same magnitude of a total thrust commanded based on a maximum lateral joystick position, and controlling a plurality of marine drives accordingly.

In one embodiment, a direction for the thrust command of each of the plurality of marine drives is associated with a direction of the joystick position from the centered position.

In one aspect of the invention, a marine propulsion system for a marine vessel includes a joystick, at least one steerable marine drive, and a control system configured to receive a joystick position from the joystick and determine a commanded velocity based on the joystick position, including a velocity magnitude and direction, such that the magnitude of commanded velocity is equal for a given joystick position magnitude in all linear directions for which the joystick can be deflected, and to control the at least one marine drive accordingly.

In one embodiment, a magnitude of commanded velocity is determined based on a deflection magnitude of the joystick position from the centered position.

In one embodiment, the direction of the velocity command is associated with a direction of the joystick position from the centered position.

In one embodiment, the method includes determining a steering position for each of the plurality of marine drives based on a direction for the thrust command and/or based on a direction of the joystick position from the centered position.

In one embodiment, the control system is further configured to determine a thrust command and/or steering position for each of a plurality of marine drives based on the velocity magnitude and direction. Optionally, the method includes implementing a closed-loop controller to determine the thrust command, the steering command, and/or the trim command for the at least one marine drive based on the measured vessel velocity.

In one embodiment, a thrust magnitude commanded based on a maximum forward joystick position is the same thrust magnitude commanded based on a maximum reverse joystick position and is the same thrust magnitude of a total thrust commanded based on a maximum lateral joystick position.

In one aspect of the invention, a marine propulsion system for a marine vessel includes a joystick, at least one steerable marine drive, and a control system configured to receive a joystick position from the joystick and determine a thrust command for each of a plurality of marine drives based on the joystick position, wherein a magnitude of the thrust commanded based on a maximum forward joystick position is the same magnitude of the thrust commanded based on a maximum reverse joystick position, and is the same magnitude of a total thrust commanded based on a maximum lateral joystick position, and controlling a plurality of marine drives accordingly.

In one embodiment, direction for the thrust command of each of the plurality of marine drives is associated with a direction of the joystick position from the centered position.

In one embodiment, the method includes determining a steering position for each of the plurality of marine drives based on a direction for the thrust command and/or based on a direction of the joystick position from the centered position.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1A:
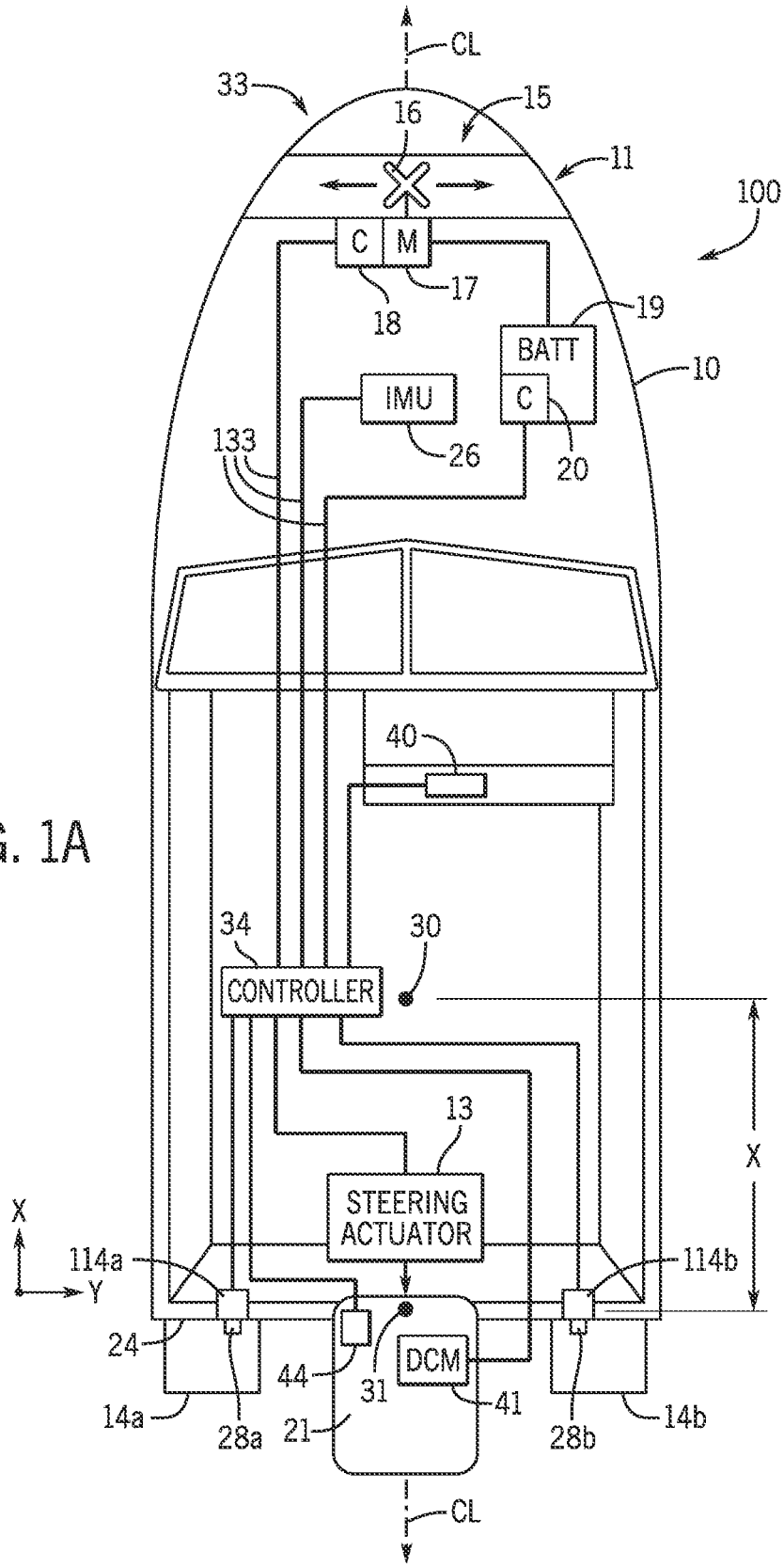
FIG. 1A is a schematic illustration of a marine vessel with one embodiment of a propulsion system according to the present disclosure.

The present inventors have recognized that improved propulsion control system and method are needed that enable vessel control at all speeds with one user input device, such as a joystick. Additionally, the inventors have recognized a need to provide a vessel control system with integrated user input control over steering, thrust, and trim that is operable to control all drives and trimmable devices in the propulsion system over a wide range of vessel speeds and conditions, such as a single user input device for controlling propulsion during docking and for controlling propulsion while the vessel is on plane and operating at high speed. The inventors have recognized that some device changes or movements will have different impacts at low speeds than at high speeds, such as for docking compared to when the vessel is on plane. For example, drastic steering and trim changes can cause unwanted effects at high vessel speeds, such as causing overly aggressive vessel turn that is uncomfortable for passengers and even inducing bow hook.

Accordingly, the inventors have recognized that adaptive algorithms are needed for interpreting user inputs from the single user input device, such as a joystick, and that can be engaged in different vessel control scenarios to provide safe and effective vessel control over all needed propulsion and trim systems for docking and other low-speed scenarios and for high-speed operation. Based on the foregoing problems and challenges in the relevant art, the inventors developed the disclosed propulsion systems and methods providing a full range of vessel control— propulsion, steering, and vessel attitude—at all speeds via a single joystick. The disclosed system simplifies vessel control for an operator and allows the operator to control all vessel propulsion functionality with one hand and at one joystick device. The joystick is an intuitive and easy-to-operate control element. It eliminates the need for throttle/shift levers, which are typically provided for each drive, and a steering wheel. This frees up significant space at the helm, and also enables placement of the joystick control device at other locations besides the helm and/or replacement of the traditional helm with a multifunction space.

The disclosed system and method may include one or multiple marine drives controlled by the joystick, including rear drives steered in parallel when in a high speed operating mode and steered to splayed angles when in a low-speed operating mode. The disclosed system and method may also include one or more lateral marine drives, such as a bow thruster. Alternatively or additionally, the disclosed system and method may include one or multiple trimmable devices configured to control vessel pitch and/or roll, including trim tabs, trimmable marine drive(s), trim deflectors, trim plates, or the like.

The joystick-based control system is operable in a full vessel control mode to enable user control of vessel velocity and direction when the marine vessel is traveling at relatively high speeds, such as a range of speeds above docking and ordinary joysticking speed limits up to a maximum vessel speed. In the full vessel control mode, the control system may be configured to automatically maintain vessel speed and heading and to interpret user inputs at the joystick as adjustments to the speed of travel and heading. For example, the system may maintain vessel speed and heading while the joystick remains in the centered position and may interpret a joystick movement (deflection and/or twist) as an instruction to adjust the heading or speed, where the magnitude of the joystick position away from the centered position corresponds with a magnitude of the adjustment.

In the full vessel control mode, the joystick positions may be associated with a commanded vessel acceleration and a commanded vessel turn rate, which are implemented as adjustments to the speed and heading being maintained by the control system. Thus, whereas in the low-speed control mode joystick positions may be associated with a velocity and heading command, in the full vessel control mode the joystick positions may be associated with an acceleration and/or a turn rate command. Once the joystick is released by the user so that it returns to the centered position, then the control system maintains the last-updated velocity and heading command. In certain embodiments, closed-loop control algorithms may be implemented to effectuate the commanded acceleration and turn rate, and to maintain the velocity and heading thereafter.

The system may also be configured to enable user adjustment to vessel attitude, including vessel pitch and/or vessel roll, via the joystick. Alternatively or additionally, the control system may be configured to automatically control pitch and yaw based on the user inputs at the joystick to optimize passenger experience and safety. Namely, closed-loop control algorithms may be configured to control vessel attitude to desirable values based on user input, such as a turn command, and to utilize feedback from a navigation sensor system configured to measure vessel turn (yaw), pitch, roll, as well as vessel velocity, to maintain those optimal values.

The control system is configured to limit user authority over propulsion control changes so as to provide safe operating conditions at high speeds. The system may be configured to limit joystick authority over certain systems and commands based on a vessel speed parameter, such as vessel speed, rpm of one or more of the drives, current demand percent of one or more of the drives, throttle position, torque output, or any other parameter correlatable with the vessel's current speed of travel. For example, the control system may be configured to progressively decrease joystick authority over vessel turn and trim adjustments as the vessel speed parameter increases, such as above a threshold speed. Thereby, overly aggressive steering of the marine drives and overly aggressive trim changes—which may be via trim tabs, propulsion device trim, or the like—are prevented at high operating speeds.

Thus, the control system is configured to provide less joystick authority over steering and trim of the marine drives on the vessel at high vessel speed parameter values, where the vessel is on plane, compared to the joystick authority to effectuate steering and trim changes at low vessel speed parameter values, such as for docking. For example, in the full vessel control mode, the permitted range of steering angles for the marine drive(s) commandable via the joystick may be narrower than the range of steering angles commandable in the low-speed joysticking mode. The permitted range of trim positions may also be more restricted in the full vessel control mode than in the low-speed mode. Alternatively or additionally, the rate of trim and/or steering adjustments permitted based on joystick inputs may be restricted to avoid effectuating quick steering or trim changes that create unintended vessel movements or uncomfortable passenger experiences. Similarly, the control system may be configured to progressively decrease joystick authority over thrust produced by a lateral thruster, such as a bow thruster, as the vessel speed parameter increases above a threshold speed.

The system is configured such that the full vessel control mode can be engaged and disengaged by a user, such as via a button or trigger on the joystick. In certain embodiments, the control system may default to a low-speed control mode when the full vessel control mode is not engaged, such as a docking control mode where output limits are engaged to prevent the vessel from exceeding a low-speed threshold appropriate for operating in marinas or other tight waterways.

Joysticking control at low speeds is known. However, in addition to the shortcomings and problems in the art listed above, the inventors have recognized a problem with current low-speed joysticking systems is that vessel response and direction do not correspond close enough with the direction of the inputs. For example, when the user deflects the joystick 45 degrees toward forward-starboard, the vessel response of existing joystick-controlled propulsion systems will be substantially more forward than starboard. This is because existing systems provide more propulsion authority in the forward direction than in the lateral, or sideways, direction. Thus, a 45 degree deflection of the joystick commands comparatively more forward-direction thrust than sideways direction thrust, causing the vessel to move predominantly forward and not at a 45 degree angle that corresponds with the direction of the joystick command.

Based on the identified shortcomings of prior art joysticking systems, the inventors recognized a need for improved low-speed joysticking control that provides equal authority and response in all linear directions. In one embodiment of the disclosed system, when the full vessel mode is disengaged and the joystick control is being operated in a low-speed mode, the system is configured to determine propulsion and steering commands for the vessel based on a deflection magnitude of the joystick from the centered position. The magnitude of commanded velocity is equal for a given deflection magnitude in all linear directions. The direction of the velocity command is associated with a direction of the joystick position from the centered position. Thus, a 45 degree deflection of the joystick will produce an equal response in both commanded directions and the vessel will travel at 45 degrees from its current position (such as without any heading change).

Figure 1B:
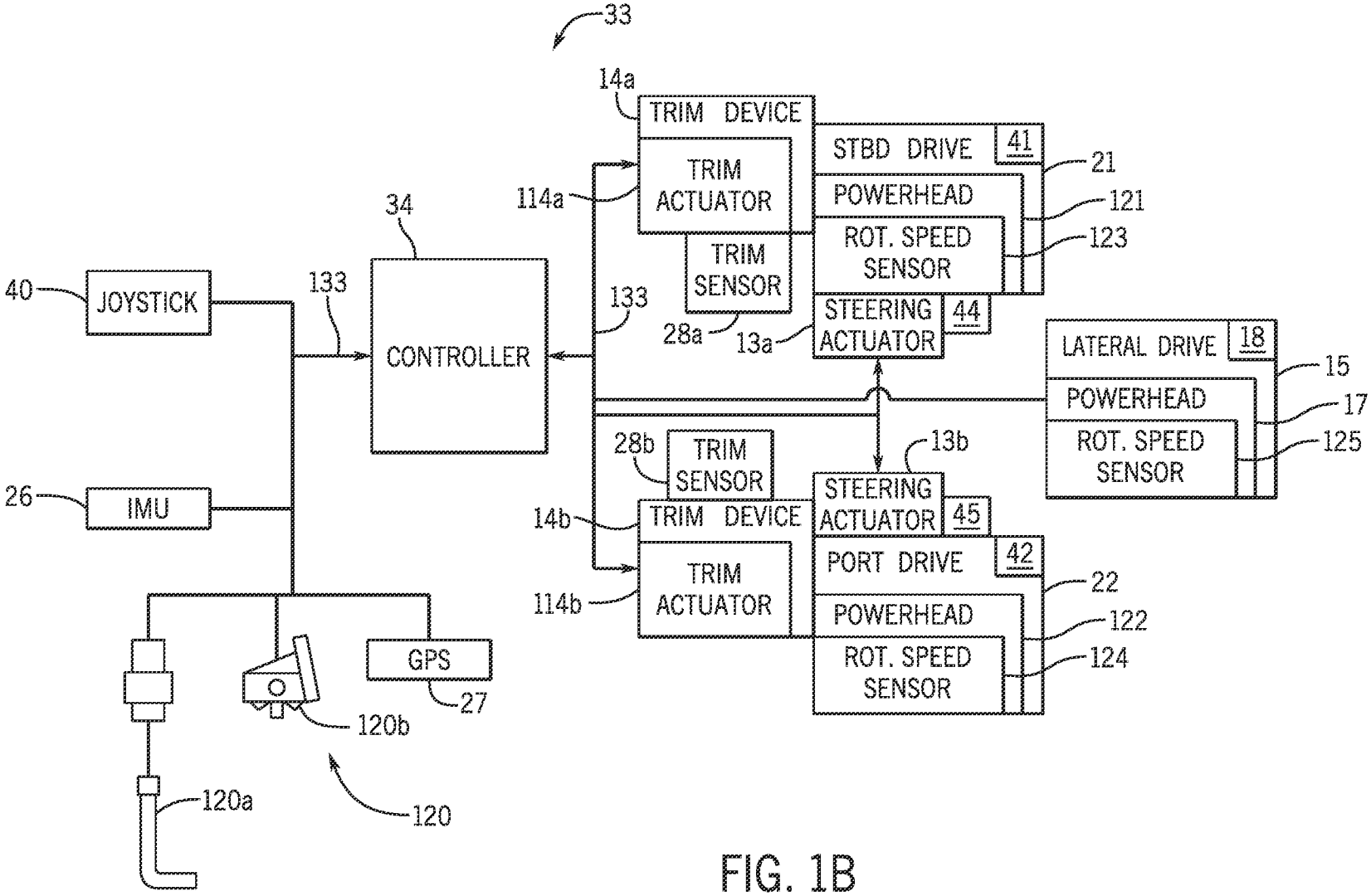
FIG. 1B is a schematic illustration of another embodiment of a marine propulsion system according to the present disclosure.

FIGS. 1A and 1B are schematic representations of a marine vessel 10 equipped with propulsion system 100. The embodiment shown in FIG. 1A includes one rear marine drive 21 positioned at the stern 24, such as attached to the transom. The single rear marine drive 21 may be mounted along a centerline CL of vessel 10. The single rear marine drive 21 may be, for example, an outboard drive, a stern drive, an inboard drive, a jet drive, or any other type of steerable drive. The rear marine drive 21 is steerable, having a steering actuator 13 configured to rotate the drive 21 about its vertical steering axis 31. The steering axis 31 is positioned at a distance X from the center of turn (COT) 30, which could also be the effective center of gravity (COG). The marine vessel 10 is maneuvered by causing the rear marine drive to rotate about its steering axis 31. The rear marine drive 21 is rotated in response to an operator's manipulation of the steering wheel 12 or joystick 40, which is communicatively connected to the steering actuator 13 to rotate the marine drive 21. Rotating the rear marine drive 21 and effectuating thrust thereby cause rotation of the marine vessel 10 about the effective COT 30.

Also referencing FIG. 1B is a schematic representation of a propulsion system 100 is shown including two rear marine drives 21 and 22 configured to be positioned at the stern 24, such as attached to the transom. The number of marine drives is exemplary and a person having ordinary skill in the art will understand in light of the present disclosure that any number of one or more marine drives may be utilized in the disclosed system and method. Each rear marine drive 21, 22 is individually and separately steerable, each having a respective steering actuator 13*a*, 13*b* configured to rotate the drive 21, 22 about its respective steering axis according, as is standard. The steering axes 31 and 32 are separated by a dimension along the Y axis and at a distance X from the center of turn 30 (COT), which could also be the effective center of gravity (COG). The marine vessel 10 is maneuvered by causing the first and second marine drives to rotate about their respective steering axis. The rear marine drives 21 and 22 are rotated in response to an operator's manipulation of the joystick 40, which is communicatively connected to the steering actuators 13*a*, 13*b*, which rotate the marine drives 21 and 22. Rotating the rear marine drives 21 and 22 and effectuating thrusts thereby cause turn of the marine vessel 10, which in a low-speed docking control mode may include turn about the effective COT 30.

In both depicted embodiments, propulsion system 100 further includes a lateral marine drive 15 configured to effectuate lateral thrust on the vessel 10 in the starboard and port directions. The lateral marine drive is fixed, not steerable, such that it produces port-direction or starboard-direction lateral thrusts at fixed angles with respect to the marine vessel, such as perpendicular to the centerline CL. In the depicted example, the lateral marine drive 15 is an electric drive positioned at a bow region 11 of the vessel 10 configured to effectuate lateral thrust at the bow, which may also be referred to as a bow thruster. The bow region 11 is near the bow of the vessel so as to be in front (toward the bow) of the COT 30. Bow thrusters are known to those skilled in the art, as are other types and locations of marine drive arrangements configured to effectuate lateral thrusts on the vessel 10, and likewise the lateral marine drive 15 may be placed at other locations on the vessel 10 besides the bow region 11 and/or two or more lateral marine drives 15 may be included and located at different locations. The lateral marine drive 15 may be a discrete drive, or discrete thruster, that operates only at a predetermined RPM and thus is only controllable by turning on and off the drive. Alternatively, the lateral marine drive 15 may be a proportional drive, or proportional thruster, wherein the rotational speed (e.g., rotations per minute RPM) is controllable by the control system 33 between a minimum RPM and a maximum RPM that the drive is capable or rated to provide. A person having ordinary skill in the art will understand in view of the present disclosure that the disclosed propulsion system 100 may include other types and locations of lateral marine drives 15, which may be an alternative to or in addition to a lateral drive 15 positioned at the bow region 11.

The lateral marine drive 15 may include a propeller 16, sometimes referred to as a fan, that is rotated by a bi-directional motor 17 in forward or reverse direction to effectuate lateral thrust in the starboard or port directions. In such an embodiment, the lateral marine drive 15 is configured to rotate in a first direction to generate a starboard direction lateral thrust and to rotate in an opposite direction of the first direction to generate a port direction lateral thrust. The controller 34 may be communicatively connected to a drive controller 18 for the lateral marine drive 15 to control activation and direction of thrust by the lateral marine drive 15. Where the lateral drive 15 is configured as a discrete drive, the controller 18 provides on/off and directional control of the motor 17, and thus rotate in the clockwise and counterclockwise directions at a single speed. The controller 34 may be configured to modulate the duty cycle of the discrete lateral drive to achieve desired thrust outputs. In other embodiments, the lateral marine drive 15 is a variable speed drive, wherein the motor 17 is controllable to rotate the propeller 16 at two or more speeds. For example, the motor 17 may be a brushless DC motor configured for variable multi-speed control of the propeller 16 in both the clockwise and counterclockwise rotation directions to effectuate a range of lateral thrust outputs and directions. In other embodiments, the lateral drive 15 may include any type of powerhead, such as any type of motor, engine, or other element to drive rotation of the propeller 16.

Where one or more of the marine drives 15, 21, 22 is an electric drive—i.e., having a powerhead 121, 122, 115 being an electric motor—the propulsion system 100 will include a power storage device 19 powering the motor(s) thereof. The power storage device 19, such as a battery (e.g., lithium-ion battery) or bank of batteries, stores energy for powering the electric motor(s) (e.g., motor 17) and is rechargeable, such as by connection to shore power when the electric motor is not in use or by an on-board alternator system drawing energy from engine-driven marine drives (if any) on the marine vessel. The power storage device 19 may include a battery controller 20 configured to monitor and/or control aspects of the power storage device 19. For example, the battery controller 20 may receive inputs from one or more sensors within the power storage device 19, such as a temperature sensor configured to sense a temperature within a housing of the power storage device where one or more batteries or other storage elements are located. The battery controller 20 may further be configured to receive information from current, voltage, and/or other sensors within the power storage device 19, such as to receive information about the voltage, current, and temperature of each battery cell within the power storage device 19. In addition to the temperature of the power storage device, the battery controller 20 may be configured to determine and communicate a charge level to the central controller 34 and/or another controller within the control system 33. The charge level may include one or more of, for example, a voltage level of the power storage device, a state of charge of the power storage device 19, a state of health of the power storage device 19, etc.

The controller 34 may receive inputs from several different sensors and/or input devices aboard or coupled to the marine vessel and configured to operate within the control system 33. For example, the controller 34 receives a steering input from the joystick 40, which may be configured as the only user input device for controlling steering and throttle, as described above. The controller 34 is provided with an input from a vessel speed sensor 120. The vessel speed sensor 120 may be, for example, a pitot tube sensor 120*a*, a paddle wheel type sensor 120*b*, or any other speed sensor appropriate for sensing the actual speed of the marine vessel. Alternatively or additionally, the vessel speed may be obtained by taking readings from a GPS device 27, which calculates speed by determining how far the vessel has traveled in a given amount of time. The marine drives 21 and 22 are provided with rotational speed sensors 123, 124, such as but not limited to tachometers. The speed sensors 123, 124 may be configured to determine a rotational speed of the powerheads 121 and 122 powering, or driving rotation of, the marine drives 21 and 22 in rotations per minute (RPM). Alternatively, the speed sensors 123, 124 may be configured to determine the rotational speed of the propellers effectuating thrust, such as rotational speed of the propeller shaft, or any element between the powerhead 121, 122 and the propellers of each drive 21, 22.

The control system 33 may be configured to receive orientation measurements describing pitch, roll, and yaw positions of the vessel 10, as well as vessel speed values, from a navigation sensor system. For example, the navigation sensor system may include an inertial measurement unit (IMU) 26 or other sensor capable of measuring vessel orientation and/or the rate of change thereof. In another example, the navigation sensor may include an attitude and heading reference system (AHRS) that provides 3D orientation of the marine vessel 10 by integrating gyroscopic measurements, accelerometer data, and magnetometer data. A gyroscope, motion reference unit (MRU), tilt sensor, IMU, AHRS, or any combination of these devices could be used. In another example, separate sensors may be provided for sensing pitch, roll, and/or yaw of the marine vessel 10. Alternatively or additionally, the navigation sensor system may include a global positioning system (GPS) 27 or a global navigation satellite system (GNSS) located at a preselected fixed position on the vessel 10, which provides information related to the global position of the vessel 10. In other embodiments, the system 100 may include an inertial navigation system (INS). Signals from the GPS receiver 27 (or GNSS or INS) and/or the IMU 26 (or AHRS) are provided to the controller 34. Alternatively or additionally, one or more vessel speed sensors 120 may be provided, such as a pitot tube or paddle wheel, to measure vessel speed over water.

The user steering inputs provided at the joystick 40 are received by the control system 33, which may include multiple control devices communicatively connected via a communication link 133, such as a CAN bus (e.g., a CAN Kingdom Network), to control the propulsion system 100 as described herein. It should be noted that the extent of connections and the communication links 133 may in fact be one or more shared connections, or links, among some or all of the components in the system. Moreover, the communication link 133 lines in FIGS. 1A and 1B are meant only to demonstrate that the various control elements are capable of communicating with one another and do not represent actual wiring connections between the various elements, nor do they represent the only paths of communication between the elements. Additionally, the system 100 may incorporate various types of communication devices and systems, and thus the illustrated communication links 133 may in fact represent various different types of wireless and/or wired data communication systems.

The control system 33 includes a central controller 34 communicatively connected to the drive control module (DCM) 41, 42 for each of the rear marine drives 21 and 22, the DCM 18 of the lateral marine drive 15, and may also include other control devices such as the battery controller 20. Thereby, the controller 34 can communicate instructions to the DCM 41, 42 of the rear drives to effectuate a commanded magnitude of thrust and a commanded direction of thrust (forward or reverse), as is necessary to effectuate the lateral and/or rotational steering inputs commanded at the joystick 40. The controller also communicates a steering position command to the steering actuators 13*a*, 13*b* to steer each of the rear marine drives 21, 22. Drive position sensors 44, 45 are configured to sense the steering angle, or steering position, of a respective one of the drives 21, 22. The central controller 34 also communicates a command instruction to the DCM 18 for the lateral marine drive, wherein the commands to the various drives 15, 21, 22 are coordinated such that the total of the thrusts from the rear and lateral marine drives yields the user's propulsion demand input. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Certain examples are depicted and described for systems with a single rear marine drive. A person of ordinary skill in the art will understand in view of the present disclosure that the described embodiments may be adapted for use with propulsion systems having two or more rear marine drives, such as the exemplary system depicted in FIG. 1B. Basic vector calculations involved in joystick control for low-speeds using multiple rear marine drives steered to splayed angles is known in the relevant art, including as disclosed in the patents and applications incorporated by reference above.

In a joysticking mode, the user operates the joystick 40 to command the rotational and/or translational movements. The joysticking mode may have various activation and operation requirements, which may be associated and confined to different vessel speed parameter ranges. For example, the control system 33 may implement a maximum speed threshold requirement prior to permitting activation of a particular joysticking control mode. For instance, a low-speed joysticking mode may be only activatable when the vessel speed is less than a threshold, such as less than 15 mph or less than 10 mph, such as based on vessel speed measurements from one or more vessel speed sensors 120. Above that threshold, only a high-speed joysticking mode may be activatable where the control system 33 is configured to steer the rear drives in parallel and limit user authority over steering and trim movements for safe vessel control at high vessel speed. Alternatively or additionally, availability of the low-speed and/or high-speed joysticking modes may be based on other vessel speed parameters other than the measured speed of travel, such as pseudo vessel speed, propulsion RPM (e.g. rotational speed of the powerhead or the propeller), torque output, current consumption of the powerhead, throttle position, demand percent, or some other determinable value correlated to the vessel speed of travel. Alternatively or additionally, engaging or switching between the low-speed and/or high-speed joysticking modes may depend on position(s) of the throttle/shift lever and/or steering wheel, and/or some other user input devices. However, it should be understood that embodiments of the disclosed system do not require other user input devices and in some embodiments may be provided as a replacement for steering wheel and throttle/shift levers.

Figure 2:
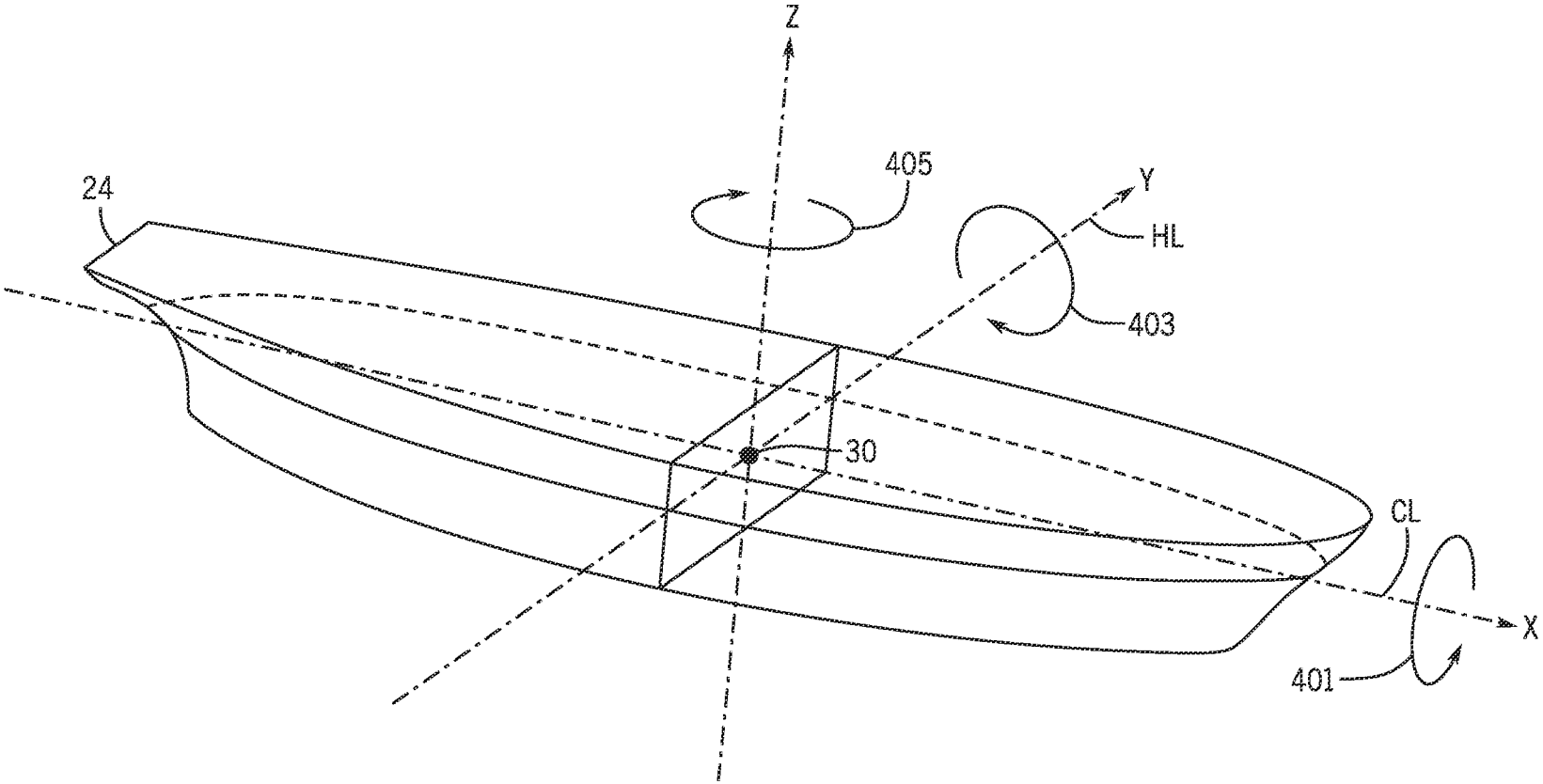
FIG. 2 illustrates a marine vessel and a coordinate system for defining movement and attitude of the marine vessel.

With reference to FIG. 2, a marine vessel's attitude can be described by its roll around an x-axis aligned with the vessel's longitudinal centerline CL, its pitch around a y-axis aligned with the vessel's horizontal centerline HL, and its yaw around a z-axis running through the vessel's COT 30. Roll angle can be calculated by an angular difference from a horizontal plane defined by the x- and y-axes. As used herein, a positive roll angle is around the x-axis in the direction of the arrow 401 shown in FIG. 2. A negative roll angle is in the opposite direction. As used herein, a positive pitch angle is around the y-axis in the direction of the arrow 403 shown in FIG. 2. A negative pitch angle is in the opposite direction. As used herein, a positive yaw angle is around the z-axis in the direction of the arrow 405, and a negative yaw angle is in the opposite direction.

Propulsion system 100 is configured for joystick-control and is enabled for coordinated control of propulsion speed, roll, and yaw of the marine vessel 10 via the joystick as the only user input device. The marine vessel 10 has first and second trim tabs 14*a*, 14*b*. Although in the example shown the first trim tab 14*a* is a port trim tab and the second trim tab 14*b* is a starboard trim tab, the location and orientation of the trim tabs 14*a*, 14*b* and their designation as first and second need not correspond. In other words, the port trim tab need not be the first trim tab, and the starboard trim tab need not be the second trim tab, i.e., the designations as "first" and "second" could be reversed and are merely provided for convenience of discussion. The trim tab 14*a* is actuated by a trim tab actuator 114*a* and the trim tab 14*b* is actuated by a trim tab actuator 114*b*. Trim tab sensors 28*a* and 28*b* sense a position of the trim tabs 14*a*, 14*b*. For example, these sensors 8*a*, 28*b* may be Hall Effect sensors.

Trim tabs 14*a* and 14*b* are connected to the stern 24 of the marine vessel 10. In other examples, the trim tabs may be under mount tabs. These trim tabs 14*a* and 14*b* are designed to pivot about a hinged connection point so as to change the dynamics on the underside of the hull. To put the bow region 11 of the marine vessel 10 down, both trim tabs 14*a* and 14*b* are moved down to the maximum lowered position, or maximum deployment position. For low power or trailing operation, the trim tabs 14*a* and 14*b* are lifted to the maximum raised position, or zero deployment position. Trim tabs 14*a* and 14*b* are also individually actuatable such that each trim tab 14*a* and 14*b* can be moved separately from the other (e.g., only one trim tab may be moved), to different trim positions, and trimmed in different directions. In certain embodiments, the trim devices may be elements other than trim tabs 14*a* and 14*b*, such as trim deflectors or interceptors or other hull-geometry-shaping device attached to the bottom of the transom or bottom of the hull of the marine vessel. The trim actuators 114*a* and 114*b* may likewise be any device or system configured for effectuating movement of the trim devices in accordance with the methods described herein.

Figure 3A:
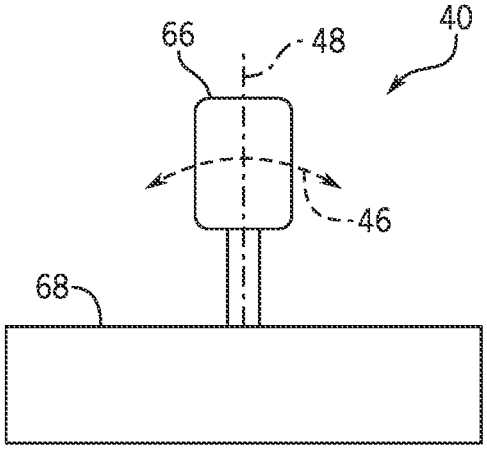
FIGS. 3A and 3B show an exemplary joystick user input device illustrating joystick positions.
Figure 3B:
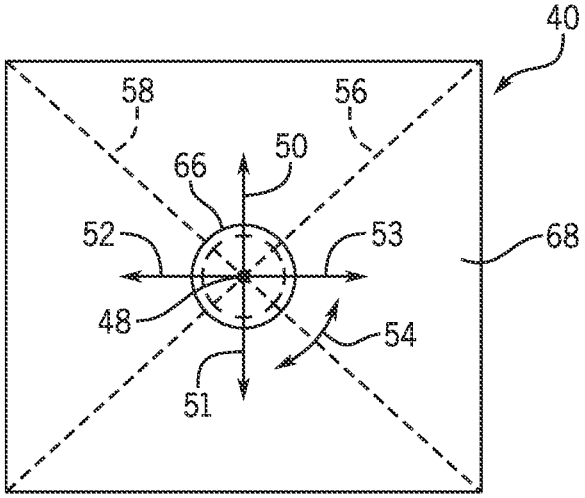

FIGS. 3A-3B demonstrate the joystick 40, where FIG. 3A is a side view and FIG. 3B is a top view illustrating the directions of movement. The handle 66 can move, as indicated by arrow 46 in FIG. 3A, in various directions with respect to a horizontal plane generally represented by arrows 50, 51, 52 and 53. However, it should be understood that the handle 66 can move in any direction relative to its axis 48 and is not limited to the two lines of movement represented by arrows 50, 51, 52 and 53. In fact, the movement of the handle 66 has a virtually infinite number of possible paths as it is tilted about its connection point within the base portion 68. Handle 66 is also rotatable about axis 48, as represented by arrow 54. Movement of the joystick is detected by one or more sensors, such as a 3-axis joystick sensor module that senses movement of the joystick with respect to the horizontal plane and rotational movement of the joystick about its vertical axis and produces a signal accordingly to indicate a position of the joystick. Note that many different types of joystick devices can be used to provide a signal that is representative of a desired movement of the vessel 10, as expressed by the operator of the marine vessel through movement of the handle 66. For example, a keypad, trackball, and/or other similar input device that allows inputs in four or more directions could be used.

With continued reference to FIG. 3B, it can be seen that the operator can demand a movement either toward port as represented by arrow 52 or starboard as represented by arrow 53, a purely linear movement in a forward direction as represented by arrow 50, or reverse direction as represented by arrow 51, or any combination of two of these directions. It should be understood that the operator of the marine vessel can also request a combination of sideways or forward/reverse linear movement in combination with a rotation as represented by arrow 54. Any of these possibilities can be accomplished through use of the joystick 40, which communicates with the controller 34 and eventually with the DCMs 41, 42 and/or other control modules within the control system 33 configured to control steering, trim, and/or thrust output.

The magnitude, or intensity, of movement represented by the position of the handle 66 the joystick 40 is utilized to determine the magnitude of the propulsion output. In other words, if the handle 66 is moved slightly toward one side or the other away from the neutral position (which is generally the centered and vertically upright position with respect to the base portion 68), the commanded thrust or change in that direction is less than if, alternatively, the handle 66 was moved by a greater magnitude away from its neutral position. Furthermore, rotation of the handle 66 about axis 48, as represented by arrow 54, provides a signal representing the magnitude or intensity of desired movement. A slight rotation of the handle 66 about axis 48 would represent a command for a slight rotational thrust about a preselected point on the vessel 10 or a slight change in vessel heading. A greater magnitude rotation of the handle 66 about its axis 48 would represent a command for a higher magnitude of rotational thrust or heading change.

The control system 33 is configured to control the propulsion system differently in response to movements of the joystick handle 66 based on the mode of operation—e.g., based on whether the control system 33 is operating the full vessel control mode or the low-speed control mode. In the low-speed mode, the control system 33 is configured to interpret sideways and/or forward deflection of the joystick as a command for purely linear movement of the marine vessel in the direction of motion of the joystick, as is standard for joystick control systems. In other words, by moving the handle 66 along dashed line 56, a linear movement toward the right side and forward is commanded without a substantial change in heading, or toward the left side and rearward as would correspond with the direction of movement of the joystick from the centered position. Similarly, a linear movement toward the left side and forward is commanded without a substantial change in heading when the joystick is moved along line 58, or and toward the right side and rearward as would correspond with the direction of movement of the joystick with respect to the centered position.

In one embodiment, the control system 33 is configured in the low-speed mode to provide equal authority in all linear directions such that, for example, a maximum deflection of the joystick straight forward will produce a first magnitude forward velocity movement of the vessel, a maximum deflection of the joystick straight back will produce the first magnitude velocity in the backward direction, and a maximum deflection to either lateral side will produce the first magnitude velocity in the respective lateral side direction (without any substantive change in heading). Having equal authority in all linear directions allows equal response in all linear directions such that the commanded thrust is calculated to move the vessel in the same direction as the movement direction of the joystick. Thus, the control system 33 commands a velocity in each linear direction based on a deflection magnitude of the joystick in that direction such that the magnitude of commanded velocity is equal for a given deflection magnitude in all linear directions. Thus, if the joystick handle 66 is deflected diagonally along line 56, for example, the vessel will travel in that direction without a material change in vessel heading. Changes in vessel heading are associated with and effectuated based on a twist of the joystick in the clockwise or counterclockwise directions, as indicated by arrow 54. Joystick position may be provided to a closed-loop controller, such as exemplified below, such that control is effectuated to minimize error between the commanded and measured velocity and heading. Alternatively, the joystick commands may be effectuated in an open-loop control arrangement, where powerhead RPM and/or thrust output and steering are commanded based on the joystick position, such as based on a map associating joystick position with steering positions of the drive(s) and rpm.

In the full vessel control mode, which is configured to enable high-speed operation of the marine vessel, the joystick position information is associated with different commands for changing propulsion output and heading than when the control system is operating in a low-speed mode. Whereas in the low-speed mode the control system 33 is configured to limit joystick authority over vessel speed—i.e., to impose a maximum vessel speed or other vessel speed parameter commandable by a user via the joystick—in the full vessel control mode the control system 33 is configured to enable full joystick authority over vessel speed so that the user can get the marine vessel on plane and operate all aspects of propulsion, steering, and orientation control at top vessel speeds. In one embodiment, in the full vessel control mode, a maximum vessel speed is commandable by the joystick up to a maximum output capability of the at least one marine drive (and/or up to the total maximum output capability of all rear marine drives in the propulsion system 100 together).

However, joystick authority over trim and steering actions is limited in the full vessel control mode to prevent overly aggressive adjustments when the vessel is traveling at high speed. The control system 33 may be configured to effectuate less aggressive steering and trim changes at high speeds and/or to limit the maximum steering angle that a drive can be steered to and/or a maximum trim position that a trimmable device (such as the marine drive and/or a trim tab) can be commanded to by the joystick based on the speed parameter value. Graph 180 at FIG. 4A exemplifies this relationship for trim and steering, where command authority of the joystick decreases as the vessel speed parameter increases. Line 182 represents the maximum permitted steering and/or trim authority for the joystick based on the vessel speed parameter. In various examples, the maximum joystick authority over steering may be limited by limiting the maximum steering angle to which the drives can be turned (which are generally steered in parallel in the full vessel control mode), and/or by limiting the maximum steering change rate (i.e., the maximum rate that the steering angle can be adjusted), and/or by limiting the maximum turn rate of the marine vessel. Similarly, the maximum joystick authority over trim may be limited by limiting the maximum trim position that a trimmable device (e.g., the marine drives 21 and 22 and/or trim tabs 14*a* and 14*b*) can be commanded to based on joystick inputs, and/or by limiting the maximum trim change rate (i.e., the maximum rate that the trim position can be adjusted), and/or by limiting a maximum rate of change of roll or pitch. As described in more detail below, limiting the vessel turn rate and/or vessel roll or pitch rate may be implemented using closed-loop control algorithms.

Where the propulsion system 100 includes multiple marine drives in addition to the lateral drive 15, such as multiple rear marine drives (e.g., drives 21 and 22), the control system 33 may be configured to utilize the propulsion output of one or more of the other marine drives as the speed characteristic. For example, the speed parameter may be an average of measured propulsion output values from a plurality of drives, such as an average RPM of multiple rear marine drives taken over a predefined period of time.

When the speed parameter of propulsion is in a lower speed range, full output authority for controlling the trim and steering is provided. For example, in the lower speed range, the maximum allowable steering angle and steering rate of change may be equal to a maximum configuration and capability of the steering actuator(s) 13. Similarly, in the lower speed range, the maximum allowable trim angle and trim rate of change may be equal to a maximum configuration and capability of the trim actuator(s) (e.g., trim tab actuators 114*a* and 114*b* and/or a trim actuator for the marine drive). The lower speed range may be defined based on a first speed threshold 194 below which full output authority over steering and trim is granted.

Figure 4A:
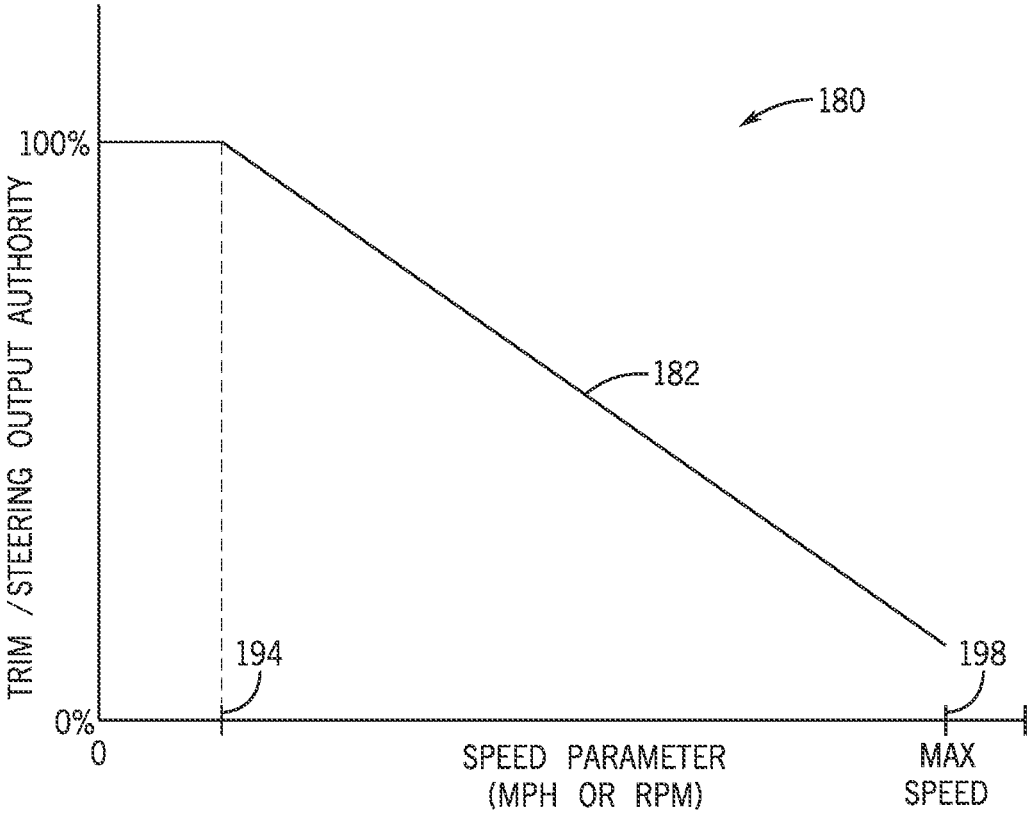
FIGS. 4A and 4B are graphs of joystick authority versus speed parameter values representing exemplary control provided in the full vessel control mode according to the present disclosure.

Above the first speed threshold 194, the joystick authority over trim and/or steering decreases, and may be configured as shown by line 182 in FIG. 4A such that the maximum allowable trim and/or steering positions and/or adjustment rates progressively decreased as the speed parameter increases toward the maximum speed 198. The maximum vessel speed parameter 198 is, for example, a maximum achievable forward-direction vessel speed for the propulsion system 100 or maximum achievable output of the rear marine drive 21. At the maximum speed, the joystick authority over trim and/or steering is severely limited. For example, the trim and steering may be limited to a narrowed range of steering angles and trim positions, and/or to significantly slower rates of steering and trim changes than permitted in the lower speed range, such as to predetermined narrowed range values or a predetermined percentages of the maximum values permitted in the lower speed range.

The output authority may be linearly related to the speed parameter, as illustrated by the graph 180. Alternatively, the joystick authority may be decreased in a stepwise function as the speed parameter increases, such as decreased at multiple thresholds between the first speed threshold 194 and a maximum speed threshold 196. In such an embodiment, the lateral output authority may decrease below 100 percent of the absolute maximum permitted position/rate values (e.g., to 75 percent) when the speed parameter is above the first speed threshold 194, and may decrease to a second predetermined value (e.g., 50 percent) at a second speed threshold, etc. Other relationships between the joystick authority and speed parameter are contemplated, such as a non-linear relationship. For example, the joystick authority over trim and steering output may decrease slowly at speeds just above the first speed threshold and the rate of decrease may increase as the speed parameter approaches the maximum speed threshold 196.

Figure 4B:
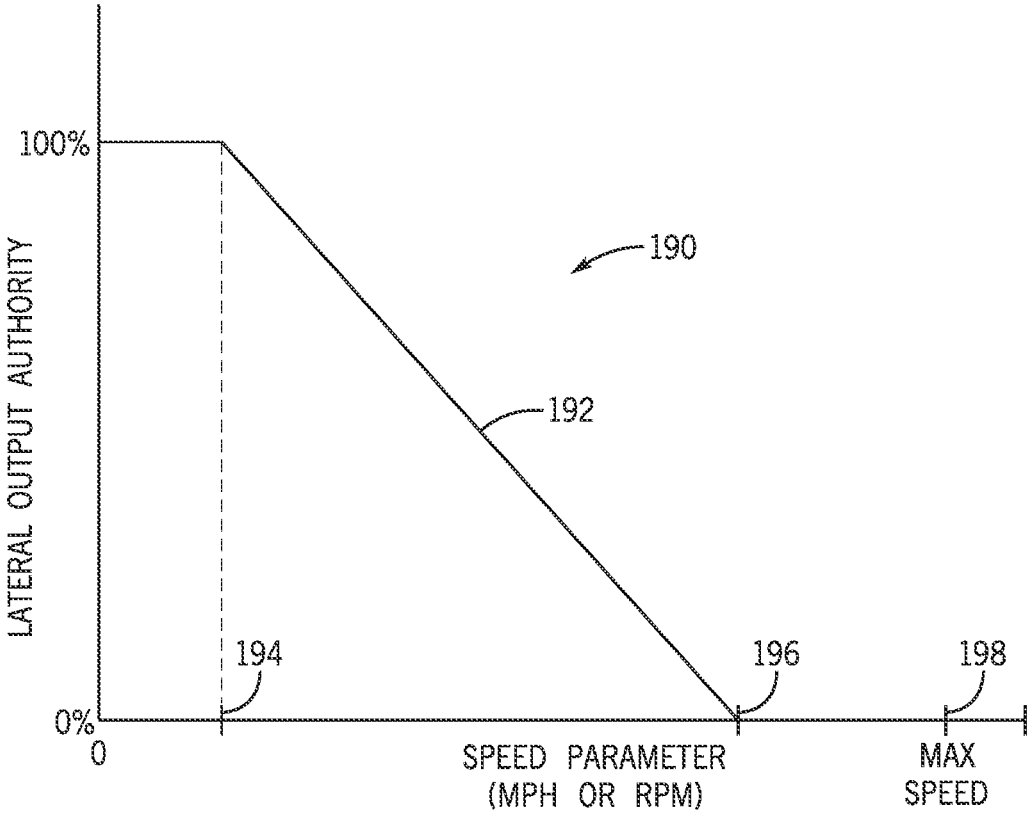

Authority over other propulsion control parameters may also be limited in the full vessel control mode, as appropriate. For example, where the propulsion system 100 includes one or more lateral drives 15, the control system 33 may be configured to limit their output based on the speed parameter. Graph 190 in FIG. 4B depicts one exemplary relationship between lateral output authority over a lateral marine drive 15 and a speed parameter of propulsion. Similar to the trim and steering authority, the maximum allowable lateral output progressively decreases as the speed parameter increases.

When the speed parameter of propulsion is in a lower speed range, full output authority for controlling the lateral marine drive is provided. For example, in the lower speed range, the maximum allowable lateral output may be equal to a maximum capability of the lateral marine drive, such as a maximum RPM or a maximum torque output rated for the lateral marine drive, or 100 percent demand. The lower speed range may be defined based on a first speed threshold 194 below which full output authority over the lateral marine drive 15 is granted. Thus, in the lower speed range below the first speed threshold 194, the lateral marine drive 15 is controlled based on user input up to the maximum permitted output (e.g., the maximum rated capability) of the lateral marine drive.

Above the first speed threshold 194, the maximum allowable lateral output decreases, and may be configured as shown in FIG. 4B such that the maximum allowable lateral output 192 is progressively decreased as the speed parameter increases. In the middle speed range between the first speed threshold 194 and a maximum speed threshold 196, the lateral output authority may be linearly related to the speed parameter, as illustrated by the graph 190. Alternatively, Other relationships between the lateral output authority and speed parameter in the middle speed range are contemplated, such as a stepwise function as described above or a non-linear relationship.

The maximum allowable lateral output may be zero in an upper speed range of the speed parameter so that the lateral marine drive 15 does not produce any thrust output at high speeds, such as when the marine vessel is on plane. As exemplified in FIG. 4B, the control system 33 may be configured to set the maximum allowable lateral output 192 to zero when the speed parameter exceeds the maximum speed threshold 196, and the maximum allowable lateral output is maintained at zero up to the maximum vessel speed parameter 198.

The maximum speed threshold 196 at which the maximum allowable lateral output 192 is set to zero may be anywhere between the first speed threshold and the absolute maximum speed 198, and may be a configurable value based on the configuration of the marine vessel, including the hull shape, vessel stability, propulsion capabilities, intended purpose of the vessel 10, etc. For example, the maximum speed threshold 196 may be set equal to or less than an expected planing speed of the marine vessel 10. Alternatively, the maximum speed threshold 196 may be significantly less than the planing speed. In one example, the maximum speed threshold 196 such as at or above the upper end of a traditional joysticking speed range, such as around 10-12 miles per hour or propulsion output values associated therewith. In still other embodiments, some lateral propulsion output may be permitted for speed parameters above the expected planing speed threshold. For example, large and stable vessels, some non-zero percentage of lateral output authority may be maintained up to the absolute maximum speed 198.

Figure 5:
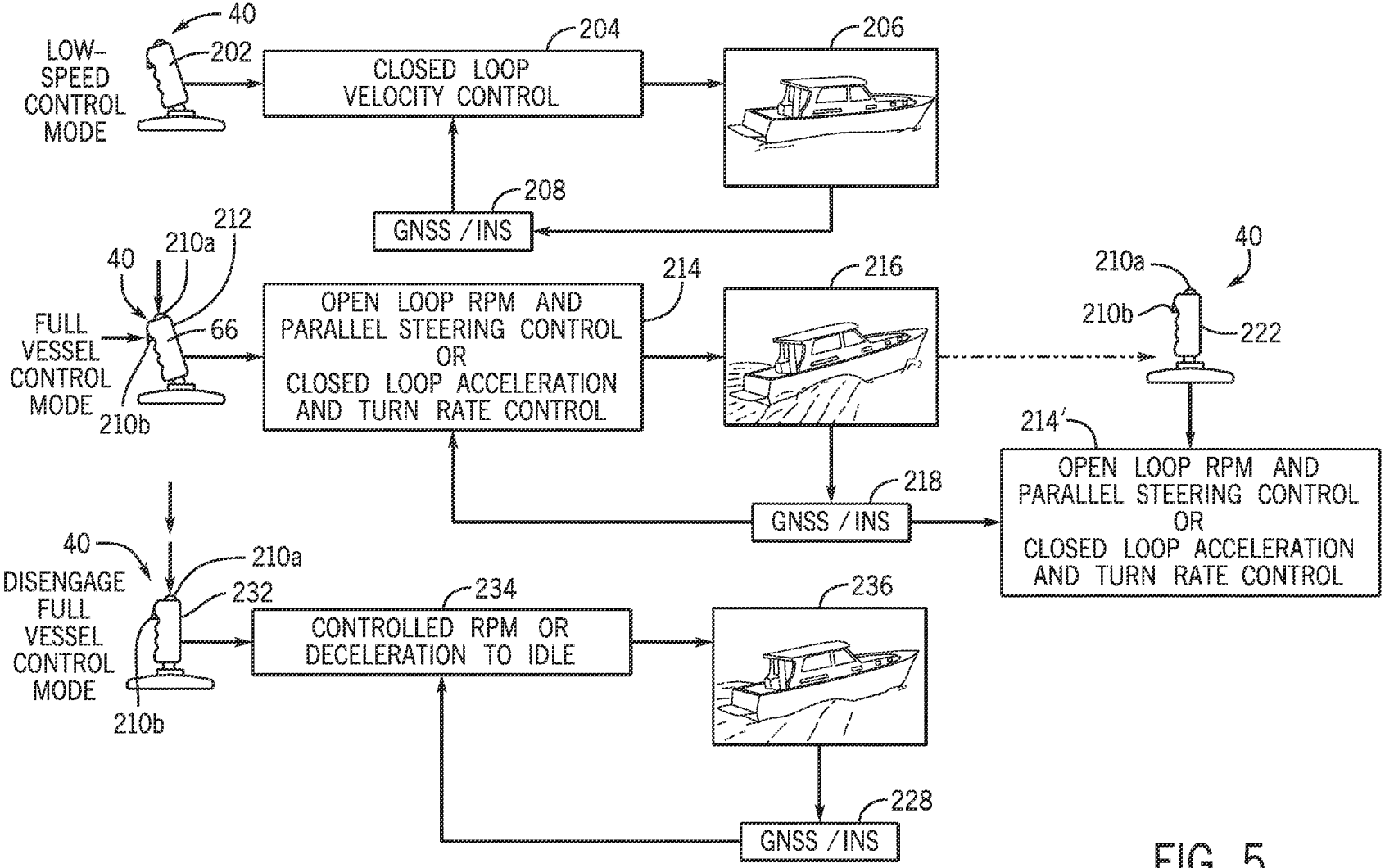
FIG. 5 is a diagram illustrating an exemplary method and control system for controlling propulsion of the marine vessel based on joystick inputs when a full vessel control mode is engaged and not engaged in accordance with an embodiment of the present disclosure.

FIG. 5 depicts exemplary methods and control functionality for controlling propulsion of the marine vessel based on joystick inputs when the low-speed control mode is engaged, when a full vessel control mode is engaged, and when the full vessel control mode is disengaged. In the depicted example, the low-speed control mode is the default control mode automatically engaged when the full vessel control mode is not engaged. The user provides a joystick input at step 202. The non-zero joystick position is received by the closed-loop velocity controller 204, which generates thrust and steering commands for each of the at least one marine drive(s) (e.g., drives 21 and 22) to effectuate the commanded velocity and direction. In the low-speed control mode, the maximum velocity commandable by the joystick is limited, and in some embodiments may be equally limited in all directions so as to provide a symmetrical and uniform response in all linear directions, as described above. The vessel velocity and heading are measured at step 208, such as based on input from a GNSS, INS, IMU and/or other navigation sensor. The measurement is provided as feedback to the closed-loop velocity controller, which then adjusts the thrust and steering commands as needed so that the measured vessel velocity and heading follows the commanded velocity and heading as closely as possible.

User input is received at step 212 to engage the full vessel control mode, which in the depicted example is pressing a top button 210*a* on the joystick handle 66. Alternatively, the full vessel control mode could be engaged by pressing the trigger 201*b*, or by other input mechanisms on the joystick or elsewhere on a user input system. In one example, the system may be configured to receive a first user input (e.g., hold button 210*a*) to engage the full vessel control mode and a second user input to enable joystick adjustment of speed, heading, and/or attitude. This reduces the chance of a user inadvertently providing propulsion adjustment inputs, such as by accidentally bumping the joystick when the full vessel control mode is engaged. For example, the system may be configured to require that the user push the trigger 210*b* in conjunction with a handle 66 movement to provide an adjustment input. When the joystick is in the centered position and/or when the trigger 210*b* (or other adjustment confirmation input) is released, the control system 33 operates the propulsion system to hold the current commanded vessel velocity and heading, and controls trim appropriately based on user inputs and/or based on the commanded and/or measured thrust and/or turn values. In the full vessel control mode, the joystick position inputs are provided to the full vessel controller 214, which may be an open-loop or a closed-loop control algorithm. The full vessel controller 214 controls the steering and propulsion output of the one or more marines in the system, and also controls trim position of one or more trimmable devices, such as trimmable marine drive(s) and or trim tabs.

In an open-loop embodiment, the full vessel controller 214 associates the joystick position with a thrust command, steering command, and trim command for controlling propulsion, attitude, and heading of the vessel. To determine the thrust command, the joystick position may be associated with any variable that adjusts thrust output from one or more drives, such as RPM (powerhead RPM, propeller RPM, etc.), throttle position, torque, current, demand percent, etc. For example, a forward/backward aspect of the joystick position may be associated with a thrust change command, where the magnitude and forward or backward direction dictate the magnitude and direction (increase or decrease) of the change in thrust command. For example, a small forward push of the joystick is be associated with a small increase in the thrust command—e.g., a slightly higher commanded RPM—and a large forward push of the joystick is associated with a large increase in the forward thrust command—e.g., a large increase in RPM. Similarly, a small or large backward-direction push of the joystick may be associated with a small or large decrease in the commanded thrust, respectively. In certain embodiments, the system may be configured to execute a predetermined ramp rate so that large change commands are executed comfortably and safely.

To determine the steering command, the open-loop full vessel controller 214 may associate joystick position with a steering adjustment command, such as associating a magnitude and direction of a twisting movement of the handle 66 with a magnitude and direction of steering position and a predetermined time for holding the steering position. Alternatively, a lateral aspect of the joystick position, rather than twist, may be associated with steering. In such an embodiment, a diagonal deflection of the joystick (e.g., along diagonal lines 56 or 58 in FIG. 3B) is associated with a thrust change (increase or decrease depending on whether the joystick is deflected forward or backward) and a heading change in the port or starboard direction depending on whether the joystick is deflected left or right, respectively.

The trim adjustment may be automatically effectuated based on the thrust or heading change, such as an RPM-based and/or steering position-based trim control system. Alternatively or additionally, the control system 33 may be configured to receive user input at the joystick to adjust trim. For example, the movement axis that is not used for steering input (twist or lateral deflection) may be utilized to enable the user to input trim change commands to control vessel roll and/or pitch by commanding trim change of one or more trimmable devices. For example, a twist rotation of the joystick may be interpreted as a command to oppositely deflect the trim tabs 14*a* and 14*b* to roll the vessel, where a clockwise rotation is interpreted as a trim command to roll the vessel starboard (deflect the port side trimmable devices down and the starboard side trimmable devices up) and a counterclockwise command is interpreted as a trim command to roll the vessel port (deflect the port side trimmable devices up and the starboard side trimmable devices down). Alternatively, the joystick may be configured to provide additional user input to specify trim adjustment, such as an additional button or trigger press in combination with joystick deflection or twist to control vessel roll and/or pitch.

Alternatively, the full vessel controller 214 may be configured as closed-loop acceleration and turn rate controller. The example in FIG. 5 depicts a closed-loop embodiment, where input from the navigation sensor system is utilized to provide feedback on velocity, acceleration, heading, and rate of heading change at step 218. Joystick deflections in the forward/backward direction, or the forward/backward aspect of a joystick position, may be interpreted by the controller 214 as an acceleration command. The magnitude of the forward/backward deflection is associated with the magnitude of the acceleration/deceleration. The controller 214 outputs a thrust command to effectuate the desired acceleration. The controller 214 compares the commanded acceleration/deceleration with the measured acceleration and adjusts propulsion accordingly to drive the measured value toward the commanded value. Similarly, lateral deflection and/or twist are associated with a commanded turn rate, where a large sideways deflection or twist action away from the centered position is interpreted as a fast turn rate command and a small sideways deflection or twist action away from the centered position is interpreted as a slow turn rate command. The controller 214 determines the steering command for each drive(s) accordingly, where multiple drives are steered in parallel. The controller 214 compares the commanded turn rate with the measured turn rate by the navigation sensor system and commands the steering positions of the drives accordingly to drive the measured value toward the commanded value.

Once the desired speed and heading are achieved, the user lets go of the joystick and/or trigger 210*b* (or other adjustment confirmation input), as illustrated at step 222. When the joystick is in the centered position and/or when the trigger 210*b* (or other adjustment confirmation input) is released, the control system 33 operates the propulsion system to hold the current commanded vessel velocity and heading. The controller operates in a hold mode 214', which may be open-loop or closed-loop as described above, to maintain the vessel speed and heading and controls trim appropriately based on user inputs and/or based on the commanded and/or measured thrust and/or turn values. The autonomous speed and heading maintenance control is effectuated until a subsequent adjustment user input is received at the joystick 40 or user input is received to disengage the full vessel control mode.

The bottom section of FIG. 5 exemplifies steps that may be executed to disengage the full vessel control mode. The system is configured to receive a disengagement user input, which in the depicted example is a double press of the top button 210*a* but in other embodiments could be any of various user inputs at the joystick or other user interface element preconfigured for disengaging the full vessel control mode and/or switching to another mode. Once disengagement of the full vessel control mode is instructed, a control algorithm may be executed to perform a controlled deceleration of the vessel. This may be a closed-loop execution of the routine as shown, where the controller 234 generates thrust, steering, and trim commands 236 to decelerate the vessel according to a predetermined routine, and adjustments are made based on the feedback 238 from the navigation sensor system. Thereby, a controlled and predictable deceleration routine that brings the vessel to idle from any starting speed is executed regardless of weather or water conditions, weight of the vessel, vessel configuration, etc. Alternatively, the deceleration controller 234 may be configured as an open-loop routine, such as a predetermined reduction rate of commanded RPM, commanded torque, demand output, or other thrust command until the one or more drive(s) has reached idle conditions. In some embodiments, once idle is reached the drives may be automatically shifted to neutral or turned off.

Figure 6:
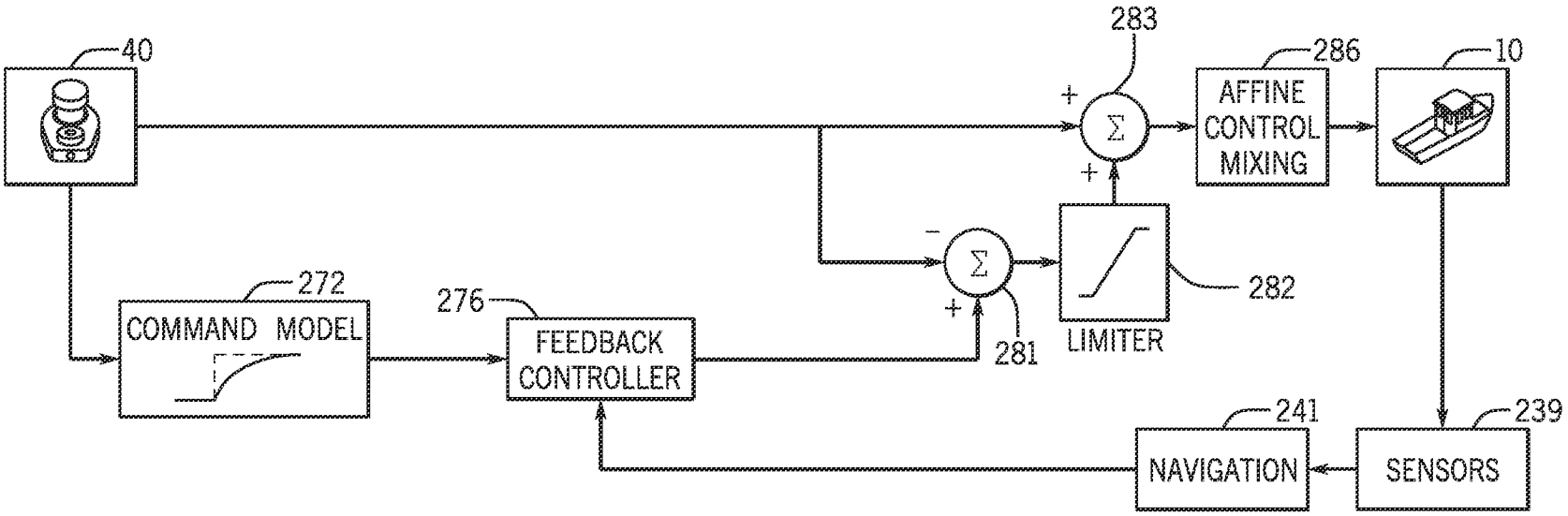
FIG. 6 is a diagram illustrating an exemplary method and control system for controlling propulsion of the marine vessel based on joystick inputs in accordance with the present disclosure.

FIG. 6 is a flowchart schematically depicting one embodiment of a control method 200, such as implemented at the controller 34, for controlling propulsion of the marine vessel in the full vessel control mode. The depicted method 200 may be implemented upon user engagement of a corresponding control mode to enable high-speed joystick control. In the depicted embodiment, the control strategy is a closed-loop algorithm that incorporates feedback into the thrust, steering, and trim command calculations by comparing a target inertial velocity or target acceleration to an actual measured velocity and/or measured acceleration of the marine vessel to provide accurate control that accounts for situational factors in the marine environment—e.g. wind and current—and any inaccuracies or uncertainties in the model. An affine control mixing strategy is utilized to convert surge (fore/aft) velocity commands and yaw velocity commands into values that can be used to control the marine drive(s), including thrust magnitude command values (e.g., demand percent, rotational speed, throttle position, current or torque amounts, etc.), thrust direction commands (e.g., forward or reverse), steering commands for the steerable drives (e.g., angular steering position), and trim commands (e.g., marine drive trim and/or other trimmable devices such as trim tabs). Exemplary embodiments of each aspect of this control strategy are subsequently discussed.

Signals from the joystick 40 (e.g., a percent deflection+/−100% in each of the axis directions) are provided to the command model 272, which computes the desired inertial velocity or desired acceleration based on the raw joystick position information. For example, the command model 272 may include a map correlating positions of the joystick to inertial velocity values, associating each possible sensed position of the joystick to a target acceleration and target turn rate values. For example, the neutral, or centered, position in the joystick is associated with a zero change in velocity or heading (zero acceleration and turn rate).

The command model 272 is configured based on the locations and thrust capabilities of the drives, the trim system (e.g., the locations and types of trimmable devices), and the vessel response to accurately approximate how fast the vessel will translate and/or turn in response to a user input. The command model is also configured to receive and account for the vessel speed parameter, such as provided by a vessel speed sensor 120 measuring actual vessel speed or pseudo vessel speed. Alternatively, the vessel speed parameter may be powerhead RPM or some other value that correlates with vessel speed, examples of which are described above. The command model is configured to command thrust, steering, and trim based on the vessel speed parameter in addition to the user input at the joystick to provide a predictable, safe, and easy-to-drive vessel at high speeds. The command model 272 is configured to reduce joystick authority over turn and trim as the vessel speed parameter increases, which may include reducing a maximum steering position and/or trim position commandable by the user via the joystick and/or reducing the rate at which steering and trim changes can be effectuated via joystick commands. For example, the turn rate command generated by the command model 272 based on a full sideways deflection of the joystick (or fill rotation of the joystick if that is the movement axis associated with turn) will be less at a maximum vessel speed than will be generated based on the same joystick input at a medium or low vessel speed.

The command model 272 may include a turn command model that accounts for desired yaw rate dynamics for the vessel. The turn rate portion of the command model 272 calculates a desired turn rate and turn angle based on the joystick position. Thus, movement of the joystick 40 is associated with how fast the boat will turn, rather than directly correlating steering input with steering angle, or angle of the propulsion device(s). Thereby, the command model 272 accounts for vessel speed and creates a constant turn rate feel on the wheel. For example, the marine drives 21 and 22 may be rotated more quickly about the steering axes when the vessel 10 is at lower speeds than when the vessel 10 is at higher speeds based on the same joystick input.

A corresponding desired roll angle may be calculated at the desired turn rate, which may be performed by the command model 272, at the feedback controller 276, or by a separate roll angle calculator. Specifically, a coordinated roll angle is calculated for the given desired turn rate, such as where the coordinated roll angle is the angle in roll for the marine vessel that will yield 1G during the turn. Thereby, the desired roll angle and/or roll rate that correlates with the desired turn rate demanded by the operator. One embodiment of roll calculations and control for effectuating turn is described at U.S. application Ser. No. 16/535,946, which is incorporated herein by reference. The desired roll angle and/or roll rate is then provided to the affine control mixer 286 which controls the trimmable device(s), such as the trimmable marine drive(s) and/or trim tabs, to effectuate the desired roll angle. The actual roll angle is measured by the sensors 239 and provided to the feedback controller where command adjustments are determined as needed.

In certain embodiments, the command model may be tunable by a user to adjust how aggressively the propulsion system 100 will respond to user inputs, which may include adjustment of its speed-based response. For example, secondary inputs may be provided that allow a user to input preference as to how the vessel will respond to the joystick inputs at certain speed ranges, such as to increase or decrease the desired velocity/acceleration values associated with the joystick positions and/or to select stored profiles or maps associated with user input values to desired acceleration values at various speeds. For example, the user inputs may allow a user to instruct an increase or decrease in the aggressiveness of the velocity/acceleration response and/or to increase or decrease a top speed that the full joystick position (e.g. pushing the joystick to its maximum outer position) effectuates, such as whether to allow the joystick to max out the propulsion speed capabilities of the propulsion system 100.

Output from the command model 272, such as target acceleration, turn rate, and roll rate, is provided to the feedback controller 276. The feedback controller 276 is configured to determine thrust commands, including desired thrust magnitude and desired direction, for the drives 21 and 22 (which are steered in parallel), and or other drives such as lateral drive 15, based on the target surge and yaw velocities or accelerations. The feedback controller 276 may also be configured to control the trimmable devices, such as to determine a desired roll and/or pitch change and control the tabs and/or trimmable drives accordingly. The feedback controller 276 may be a model-based controller, such as implementing a vessel dynamics model (e.g., an inverse plant model), optimal control modeling, a robust servo rate controller, a model-based PID controller, or some other model-based control scheme. In a closed-loop vessel dynamics model controller embodiment, the model is utilized to both calculate feed-forward commands and incorporate feedback by comparing a target velocity or target acceleration to an actual measured velocity and/or measured acceleration of the marine vessel. In a robust servo rate controller embodiment, the model is utilized to calculate feed-forward commands and the gains are computed off-line and incorporated into the control algorithm. In some embodiments, two or more different control models may be utilized, such as for calculating thrust commands for different directional control.

The control model is generated to represent the dynamics and behavior of the marine vessel 10 in response to the propulsion system 100, and thus to account for the hull characteristics and the propulsion system characteristics. The hull characteristics include, for example, vessel length, a vessel beam, a vessel weight, a hull type/shape, and the like. The propulsion system characteristics include, for example, the location and thrust capabilities of each marine drive in the propulsion system 100. In certain embodiments, the model for each vessel configuration may be created by starting with a non-dimensionalized, or generic, vessel model where the hull characteristics and the propulsion system characteristics are represented as a set of coefficients, or variables, that are inputted to create a vessel model for any vessel hull and any propulsion system in the ranges covered by the model. The set of coefficients for the hull characteristics may include, for example, a vessel length, a vessel beam, a vessel weight, and a hull shape or type.

The generic model may be created utilizing stored thrust information (e.g., representing the thrust magnitude generated by the drive at each command value, such as demand percent) associated with a set of predefined drive identification coefficients. An exemplary set of coefficients for the propulsion system characteristics may include location of each marine drive and drive identification information associated with the corresponding thrust characteristics saved for that drive, such as drive type, drive size, and/or make/model, as well as available steering angle ranges for each steerable drive. Coefficients or other selectable inputs may also be provided for trimmable devices, such as to specify the type, location, and capabilities of trim tabs and the like.

Alternatively, the feedback controller 276 may implement a different, non-model-based, control strategy, such as a calibrated map correlating the target surge, target sway, and target yaw velocities/accelerations to thrust commands for each drive in the propulsion system 100 or a calibrated map correlating joystick positions to thrust commands for each drive in the propulsion system 100. Additionally, the map may be configured to account for further control parameters in the thrust command determinations, such as battery charge level (e.g., battery SOC), of a power storage system associated with one or more of the marine drives 15, 21, 22, generated fault conditions for one or more of the devices in the propulsion system 100, or the like, whereby each control parameter is represented as an axis on the map and a corresponding input is provided for determining the thrust commands.

The output of the feedback controller 276 is compared to the joystick position information at summing point 281 (e.g., to the percent deflection value). The summed output is again subject to a limiter 282, which limits the authority of the controller 276 and accounts for fault modes. The output of the limiter 282 is summed with the joystick values at summing point 283. That summed value is provided to the affine control mixer 286, which generates a total X and Y direction command for the marine drive. From there, the powerhead control commands, shift/motor direction commands, and steering actuator control commands (for the steerable drives), trim actuator commands, are determined for each marine drive and/or trimmable device. An exemplary embodiment of affine mixing is described in U.S. Pat. No. 10,926,855, which is incorporated herein by reference.

In certain embodiments, the feedback controller 276 may be configured and implemented as a closed-loop control system, wherein the thrust commands are further calculated based on a comparison of the measured and target values. In the closed-loop control strategy depicted in FIG. 6, the feedback controller 276 is configured to determine the thrust commands based further on a comparison of the target values outputted from the command model 272, namely target surge velocity and/or acceleration and/or target yaw velocity or turn rate, to measured velocity and/or acceleration from one or more inertial and/or navigation sensors. Feedback information about the actual vessel velocity and/or acceleration is provided by the navigation sensor system on the marine vessel. For example, the output of the one or more velocity and/or acceleration sensors 239—such as an IMU 26, accelerometers, gyros, magnetometers, etc.—may be interpreted and/or augmented by location and navigation sensors 241, such as a GPS 27 or an inertial navigation system. The navigation sensor system 241 provides an actual inertial velocity (e.g., sway velocity and yaw velocity) and/or an actual acceleration that can be compared to the output of the command model 272. The controller 276 is configured to utilize such information to refine the thrust command values to accurately effectuate the desired velocity and acceleration, accounting for inaccuracies in the model design, malfunctions or sub-par performance of the marine drives, disturbances in the environment (e.g., wind, waves, and current), and other interferences.

Where the feedback controller 276 is a map-based controller, a PID controller may be utilized in conjunction with the map-determined thrust commands to determine the final outputted thrust commands and provide closed-loop control.

Alternatively, control may be implemented in an open-loop, or feed-forward, control strategy. In a feed-forward-only command regime, the output of the feedback controller 276 is utilized to control the marine drives—i.e., inputted to the affine control mixer 286 to generate thrust magnitude commands and steering commands for the drives, as well as trim commands. Accordingly, the command model 272, feedback controller 276, and affine control mixer 286 can be utilized, without the feedback portion of the system depicted in FIG. 6, to control the propulsion system in a full vessel control joysticking mode. This control strategy may be implemented on its own as a control strategy or can be implemented as a default state when the feedback portion of a closed-loop control system is inoperable (such as due to failure of navigation systems or sensors).

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A marine propulsion system for a marine vessel comprising:

a joystick;

at least one steerable marine drive;

a control system configured to:

determine a joystick position of the joystick;

in a first control mode, determine a thrust command and/or a steering command for least one marine drive based on the joystick position;

receive a user input to engage full vessel control mode;

engage the full vessel control mode such that the joystick position is associated with different commands for changing propulsion output and heading than when the first control mode is engaged, and wherein the full vessel control mode enables high-speed operation to get the marine vessel on plane and the first control mode prohibits high-speed operation to get the marine vessel on plane;

receive a vessel speed parameter;

in the full vessel control mode, determine at least the thrust command and the steering command for the at least one marine drive based on the joystick position and the vessel speed parameter; and control the at least one marine drive accordingly.

2. The system of claim 1, wherein, in the full vessel control mode, the control system is further configured to hold a current vessel velocity and a current vessel heading when the joystick position is a centered position.

3. The system of claim 1, wherein the vessel speed parameter is one of a current vessel speed, a current rotational speed of the at least one marine drive, or a current demand percent for the at least one marine drive.

4. The system of claim 1, further comprising at least two marine drives, wherein the control system is further configured to, when the full vessel control mode is engaged, determine the same steering command for each of at least two marine drives such that they are steered in parallel.

5. The system of claim 1, wherein, in the full vessel control mode, the control system is configured to decrease a maximum steering angle and/or a maximum steering change rate for the at least one marine drive commandable by the joystick based on the vessel speed parameter.

6. The system of claim 1, wherein, in the full vessel control mode, a maximum vessel speed is commandable by the joystick up to a maximum output capability of the at least one marine drive.

7. The system of claim 1, wherein, in the full vessel control mode, the control system is further configured to determine a commanded vessel acceleration and/or a commanded vessel turn rate based on the joystick position and the vessel speed parameter, and to determine the thrust command and/or the steering command based on the commanded vessel acceleration and/or the commanded vessel turn rate.

8. The system of claim 7, wherein, in the full vessel control mode, the control system is configured to determine the commanded vessel acceleration based on a forward/backward aspect of the joystick position and/or to determine the commanded vessel turn rate based on a lateral aspect of the joystick position or a rotational aspect of the joystick position.

9. The system of claim 7, wherein, in the full vessel control mode, the control system is further configured to progressively decrease the commanded vessel turn rate associated with the joystick position as the vessel speed parameter increases above a threshold speed.

10. The system of claim 7, further comprising a navigation sensor system configured to measure vessel turn and vessel velocity, wherein, in the full vessel control mode, the control system is further configured to implement a closed-loop controller to determine the thrust command, the steering command, for the at least one marine drive based on the measured vessel velocity and the measured vessel turn to effectuate the commanded vessel acceleration and the commanded vessel turn rate.

11. The system of claim 1, further comprising at least one trimmable device, and wherein, in the full vessel control mode, the control system is further configured to determine a trim position for each of the at least one trimmable device based on the joystick position and the vessel speed parameter and to control the at least one trimmable device accordingly.

12. The system of claim 11, wherein the at least one trimmable device includes a set of trim tabs, and wherein, in the full vessel control mode, the control system is further configured to implement a closed-loop controller to determine a tab position for each of the set of trim tabs to effectuate a desired vessel pitch angle and a desired vessel roll angle based on a commanded vessel acceleration and the commanded vessel turn rate.

13. The system of claim 11, wherein, in the full vessel control mode, the control system is further configured to progressively decrease a maximum trim position for the at least one trimmable device commandable by the joystick as the vessel speed parameter increases above a threshold speed.

14. The system of claim 1, further comprising at least one lateral thruster configured to generate a lateral thrust on the marine vessel, and wherein, in the full vessel control mode, the control system is further configured to determine a lateral thrust command based on the joystick position and the vessel speed parameter and to control the lateral thruster based on the lateral thrust command; and wherein the control system is further configured to progressively decrease a maximum lateral thrust by the lateral thruster commandable by the joystick as the vessel speed parameter increases above a threshold speed.

15. The system of claim 1, wherein, in the full vessel control mode, the control system is further configured to receive a user input to disengage the full vessel control mode, and then to control the at least one marine drive to decelerate the marine vessel at a predetermined deceleration rate until the vessel speed parameter reaches an idle speed.

16. The system of claim 1, wherein the control system is further configured to:

when the full vessel control mode is engaged, determine a commanded vessel acceleration and a commanded vessel turn rate based on the joystick position and the vessel speed parameter, and determine the thrust command and/or the steering command based on the commanded vessel acceleration and the commanded vessel turn rate; and when the full vessel control mode is disengaged, determine a commanded vessel velocity and a commanded vessel heading based on the joystick position in the first control mode, and determine a low-speed thrust command a low-speed steering command based on the commanded vessel velocity and the commanded vessel heading.

17. The system of claim 1, wherein, in the full vessel control mode, the control system is further configured to decrease a thrust command and/or a steering command associated with the joystick position as the vessel speed parameter increases toward a maximum vessel speed parameter.

18. The system of claim 1, wherein, in the full vessel control mode, the control system is configured to determine the thrust command based on a forward/backward aspect of the joystick position and/or to determine the steering command based on a lateral aspect of the joystick position or a rotational aspect of the joystick position.

19. The system of claim 1, wherein, in the full vessel control mode, the control system is configured to enable sufficient joystick authority over thrust output of the marine drive to get the marine vessel on plane.

20. A method of controlling propulsion of a marine vessel, the method comprising:

receiving a user input to engage full vessel control mode;

receiving a vessel speed parameter;

determining a joystick position;

determining a thrust command and a steering command based on the joystick position and the vessel speed parameter, wherein a maximum steering angle, a maximum steering change rate, and/or a maximum vessel turn rate commandable by the joystick decreases as the vessel speed parameter increases toward a maximum vessel speed parameter; and controlling an output of at least one marine drive based on the thrust command and controlling a steering position of the at least one marine drive based on the steering command.

21. The method of claim 20, further comprising determining a trim command based on the joystick position and controlling at least one trimmable device based on the trim command, wherein the at least one trimmable device is the at least one marine drive and/or a set of trim tabs.

22. The method of claim 20, further comprising controlling the at least one marine drive to maintain a current vessel velocity and a current vessel heading when the joystick position is a centered position until a joystick handle is moved away from the centered position or a user input is received to disengage the full vessel control mode.

23. The method of claim 20, further comprising progressively decreasing a maximum steering angle and/or a maximum steering change rate of the at least one marine drive commandable by the joystick based on the vessel speed parameter value.

24. The method of claim 20, further comprising determining a commanded vessel acceleration and a commanded vessel turn rate based on the joystick position and the vessel speed parameter, and determining the thrust command and/or the steering command based on the commanded vessel acceleration and the commanded vessel turn rate.

25. The method of claim 24, further comprising determining the commanded vessel acceleration based on a forward/backward aspect of the joystick position and determining the commanded vessel turn rate based on a lateral aspect of the joystick position or a rotational aspect of the joystick position.

26. The method of claim 24, further comprising progressively decreasing the commanded vessel turn rate and/or the commanded vessel acceleration associated with the joystick position as the vessel speed parameter increases above a threshold speed.

27. The method of claim 24, further comprising measuring vessel turn and vessel velocity, and implementing a closed-loop controller to determine the thrust command and/or the steering command for the at least one marine drive based on the measured vessel velocity and the measured vessel turn to effectuate the commanded vessel acceleration and the commanded vessel turn rate.

28. The method of claim 27, further comprising implementing the closed-loop controller to control a trim position for at least one trimmable device to effectuate a desired vessel pitch angle and a desired vessel roll angle based on the commanded vessel acceleration and the commanded vessel turn rate.

29. The method of claim 20, further comprising determining a tab position for each of a set of trim tabs based on the joystick position and the vessel speed parameter and controlling the set of trim tabs accordingly; and progressively decreasing a maximum tab position for the set of trim tabs commandable by the joystick as the vessel speed parameter increases above a threshold speed.

30. The method of claim 20, further comprising receiving a user input to disengage the full vessel control mode, and then controlling the at least one marine drive to decelerate the marine vessel at a predetermined deceleration rate.

31. The method of claim 20, further comprising:

when the full vessel control mode is engaged, determining a commanded vessel acceleration and a commanded vessel turn rate based on the joystick position and the vessel speed parameter, and determining the thrust command and/or the steering command based on the commanded vessel acceleration and the commanded vessel turn rate; and when the full vessel control mode is disengaged, determining a commanded vessel velocity and a commanded vessel heading based on the joystick position, and determining a low-speed thrust command a low-speed steering command based on the commanded vessel velocity and the commanded vessel heading.

32. The method of claim 31, further comprising:

when the full vessel control mode is engaged, determining the commanded vessel acceleration based on a forward/backward aspect of the joystick position and determining the commanded vessel turn rate based on a lateral aspect of the joystick position or a rotational aspect of the joystick position; and when the full vessel control mode is disengaged, determining a magnitude and direction of the commanded vessel velocity based on the forward/backward aspect and the lateral aspect of the joystick position, and determining the commanded vessel heading based on the rotational aspect of the joystick position.

33. A marine propulsion system for a marine vessel comprising:

a joystick;

at least one steerable marine drive;

a control system configured to:

determine a joystick position of the joystick;

in a first control mode, determine a thrust command and/or a steering command for the at least one marine drive based on the joystick position;

receive a user input to engage full vessel control mode that is different from the first control mode;

receive a vessel speed parameter;

in the full vessel control mode, determine at least the thrust command and the steering command for the at least one marine drive based on the joystick position and the vessel speed parameter;

wherein, in the full vessel control mode, the control system is configured to decrease at least one of a maximum steering angle, a maximum steering change rate, and/or a maximum vessel turn rate commandable by the joystick as the vessel speed parameter increases toward a maximum vessel speed parameter; and control the at least one marine drive accordingly.

* * * * *